US012486843B2

(12) United States Patent
Burnham et al.

(10) Patent No.: US 12,486,843 B2
(45) Date of Patent: Dec. 2, 2025

(54) VOLUME EXPANSION FOR CAVITATION REDUCTION IN A GEAR PUMP MESH

(71) Applicant: Triumph Engine Control Systems, LLC, West Hartford, CT (US)

(72) Inventors: Thomas L. Burnham, East Hartford, CT (US); William H. Dalton, Hebron, CT (US)

(73) Assignee: Triumph Engine Control Systems, LLC, West Hartford, CT (US)

( * ) Notice: Subject to any disclaimer, the term of this patent is extended or adjusted under 35 U.S.C. 154(b) by 0 days.

(21) Appl. No.: 18/372,480

(22) Filed: Sep. 25, 2023

(65) Prior Publication Data

US 2024/0200555 A1 Jun. 20, 2024

Related U.S. Application Data

(60) Provisional application No. 63/433,587, filed on Dec. 19, 2022.

(51) Int. Cl.
*F04C 2/08* (2006.01)
*F04C 2/18* (2006.01)

(52) U.S. Cl.
CPC ..... *F04C 2/084* (2013.01); *F04C 2/18* (2013.01); *F04C 2/088* (2013.01); *F04C 2240/20* (2013.01); *F04C 2250/20* (2013.01)

(58) Field of Classification Search
CPC ..... F04C 2/088; F04C 2/084; F04C 2/102; F04C 2/18; F04C 2250/20; F04C 2240/20; F01C 1/088
See application file for complete search history.

(56) References Cited

U.S. PATENT DOCUMENTS 1,094,291 A 4/1914 Appell
2,029,742 A * 2/1936 Sieverts ..... F04C 2/088 418/196
2,344,628 A 3/1944 Monahan
(Continued)

FOREIGN PATENT DOCUMENTS

CN 102265065 A * 11/2011 ..... F16H 55/12
CN 209138578 U * 7/2019 ..... B01J 2/22
(Continued)

OTHER PUBLICATIONS

English Machine Translation of CN102265065A via USPTO database. (Year: 2011).*
(Continued)

*Primary Examiner* — Mary A Davis
(74) *Attorney, Agent, or Firm* — Armstrong Teasdale LLP

(57) ABSTRACT

A gear having volume expansion for cavitation reduction in a gear pump mesh. The gear has a gear tooth profile; a body; a plurality of involute gear teeth extending radially outward from the body and including first and second neighboring gear teeth each having a respective tip and a root, the first and second neighboring gear teeth defining a space between them; and a root pocket formed directly into the roots of the gear teeth and in the space between the gear teeth, providing an increased gear root volume and adding trapped fluid compliance while leaving unaltered the gear tooth profile. Also disclosed is a gear pump including the gear.

22 Claims, 17 Drawing Sheets

(56) References Cited

U.S. PATENT DOCUMENTS

| | | | | |
|---|---|---|---|---|
| 2,471,915 | A * | 5/1949 | Thacher | F04C 2/088 418/206.1 |
| 2,491,365 | A * | 12/1949 | Ernst | F04C 2/084 418/72 |
| 2,975,718 | A * | 3/1961 | Hodgson | F04C 15/0046 418/102 |
| 3,021,791 | A * | 2/1962 | Rockwell | F04C 2/088 418/72 |
| 4,233,005 | A * | 11/1980 | Bottoms | F04C 2/088 418/190 |
| 6,042,352 | A | 3/2000 | Halter et al. | |
| 6,089,843 | A * | 7/2000 | Kondoh | F16C 33/121 419/30 |
| 7,878,781 | B2 | 2/2011 | Elder | |
| 8,137,085 | B2 | 3/2012 | Ni et al. | |
| 8,944,793 | B2 | 2/2015 | Ni | |
| 9,057,372 | B2 | 6/2015 | Wakefield et al. | |
| 9,932,980 | B2 | 4/2018 | Czerwonka | |
| 10,563,653 | B2 * | 2/2020 | Ribarov | F04C 2/088 |
| 2013/0034462 | A1 * | 2/2013 | Yarr | F04C 2/084 418/166 |
| 2019/0024657 | A1 | 1/2019 | George et al. | |
| 2020/0040889 | A1 * | 2/2020 | Smith | G01N 11/00 |

FOREIGN PATENT DOCUMENTS

| | | | |
|---|---|---|---|
| DE | 2412279 | A1 | 9/1974 |
| GB | 1547944 | A | 7/1979 |

OTHER PUBLICATIONS

English Machine Translation of CN209138578A via USPTO database. (Year: 2019).*

Hunt et al., Cavitation Between Meshing Gear Teeth, Wear, 71, pp. 65-78, 1981.

International Search Report and Written Opinion issued in Application No. PCT/US2023/083470 mailed on Apr. 16, 2024; pp. 1-13.

* cited by examiner

VOLUME EXPANSION FOR CAVITATION REDUCTION IN A GEAR PUMP MESH

RELATED APPLICATION

This application claims the benefit of priority to U.S. Provisional Patent Application Ser. No. 63/433,587, filed on Dec. 19, 2022, the contents of which are incorporated in this application by reference.

TECHNICAL FIELD

The present disclosure relates generally to gear systems and, more particularly, to cavitation between meshing gear teeth.

BACKGROUND OF THE DISCLOSURE

In his theory of hydraulic turbines, stated in 1754, Euler predicted the phenomenon of cavitation. It was not until 1895 that the adverse effects of cavitation were identified. Since then, a considerable amount of work has been conducted to avoid the adverse effects on metal components caused by cavitation. Such work focused initially on hydraulic turbine runners, ship propellors, valves, and piping. Later work has shown that cavitation can occur between meshing gear teeth in an oil-lubricated gear box transmitting torque. See J. B. Hunt et al., "Cavitation between meshing gear teeth," *Wear*, vol. 71, Issue 1, pages 65-78 (Sep. 1, 1981).

All pumps operate by creating a low pressure at the inlet and allowing atmospheric (or system) pressure to push fluid into the pump. The process makes all pumps susceptible to cavitation. Cavitation is the formation of vapor cavities (bubbles) inside of a liquid when the local pressure is decreased rapidly below the vapor pressure of the liquid. This pressure decrease forms a vapor bubble inside the liquid which typically lasts for a short time before collapsing back into a liquid. The collapse is violent, producing a loud popping noise and shockwaves that can damage nearby surfaces. These shockwaves can cause wear in some mechanical components. Vapor cavities that implode near solid surfaces can cause cyclic stresses through repeated exposure to such implosions. Even strong metals will be pitted when subjected to the strong, localized jet resulting from the bubble implosion. Left unchecked, the damage can eventually destroy the pump.

Referring now to the drawing, in which like reference numbers refer to like elements throughout the various figures that comprise the drawing, FIG. 1 is a cross section side view schematic diagram. FIG. 1 shows a conventional gear pump 10 having two identical spur gears 2 and 3 located within a pump housing 6. Each gear 2, 3 has a plurality of gear teeth 1 (nine teeth 1 are shown for each gear 2, 3 as an example) arrayed about its outer periphery. In the example shown, the first gear 2 is mounted on, and integrally supported by, a corresponding gear shaft 4 so that the first gear 2 rotates in a clockwise direction 2*a*. The second gear 3 is mounted on, and integrally supported by, a corresponding gear shaft 5 so that the second gear 3 rotates in a counterclockwise direction 3*a*. A motor (not shown) causes the gears 2, 3 to rotate.

As the pair of gears 2, 3 of the gear pump 10 rotate, the teeth 1 of the first gear 2 come into engagement or contact with, and then disengage from, the teeth 1 of the second gear 3. In other words, the teeth of the respective gears 2, 3 mesh with each other at a mesh location 7. When the first (operated or driving) gear 2 is rotating clockwise, which causes the second (driven) gear 3 to rotate counterclockwise, the gear pump 10 draws fluid F to be pumped through an inlet opening 8 in the housing 6, as indicated by the direction arrow 8*a*, to be transported by the rotating gears 2, 3 along the interior of the walls of the housing 6 at the outer periphery of the gears 2, 3 to an outlet opening 9 in the housing 6 at which the fluid F exits the gear pump 10 as indicated by the direction arrow 9*a*. Thus, the gears 2, 3 continually trap portions of the fluid F at one location and displace those portions to another location, thereby pumping the fluid F.

Internal cavitation can occur in the gear pump 10 at one or more of several locations. FIG. 1A illustrates one common cavitation location in the gear pump 10, where the teeth 1 of the first gear 2 approach the walls of the housing 6. FIG. 1B illustrates another common cavitation location in the gear pump 10, namely, proximate the mesh location 7. The cavitation that can occur at the mesh location 7 is explained more fully as follows.

The fluid F to be pumped is drawn into the inlet opening 8 by the gears 2, 3 coming out of mesh at a location relatively near to the inlet opening 8. In coming out of mesh, an expanding inter-tooth volume forms between the adjacent teeth 1 on each gear 2, 3 as the formerly meshed tooth 1 of the other gear exits those spaces. These inter-tooth volumes in the spaces between adjacent teeth 1 on the gear coming out of mesh are filled by fluid F from the inlet opening 8 and, as indicated above, forced to move with each gear 2, 3 between its teeth 1 along the closely adjacent interior surface of the outer wall of the housing 6 to the outlet opening 9 at the discharge side of the gear pump 10. The very small clearances between the tips of the teeth 1 on the gears 2, 3 and the corresponding housing wall interior surface, the speed of movement of the gear teeth tips along that surface, and the close proximity of the flat bearing surfaces to the sides of the gears 2, 3 as described above, keep the fluid F in the inter-tooth volumes trapped to prevent that fluid F from leaking backward towards the inlet opening 8.

At the discharge side of the gear pump 10, fluid F is forced to exit the outlet opening 9 by gears 2, 3 going into mesh at a location relatively near to the outlet opening 9 to form shrinking inter-tooth volumes between those adjacent teeth 1 on each gear 2, 3 resulting from corresponding teeth 1 of the other gear entering those spaces. As a positive displacement gear pump 10, the fluid discharge pressure is predominantly determined by the downstream conduit passageway cross sectional areas. The meshing of the teeth 1 of the gears 2, 3 at the mesh location 7 which is more or less along an axis there joining the axes of symmetry of the gear shafts 4, 5 and the presence of closely adjacent flat bearing surface portions there, has the effect of isolating the fluid F at the outlet opening 9 from that at the inlet opening 8.

Cavitation can occur in the gear pump 10 on the intake side of the gear pump 10 in the region where the teeth 1 of the gears 2, 3 separate in coming out of mesh with one another. In this region, as indicated above, the expanding inter-tooth volume between adjacent teeth 1 on each gear 2, 3 where the tooth 1 of the other gear had just been and is exiting, must be filled by the fluid F to be pumped that is entering from the inlet opening 8 under whatever is the inlet fluid pressure. As the rotational speed of the gears 2, 3 increases to reach some threshold value, the rate of the expanding inter-tooth volumes can exceed the rate such volumes can be filled by the incoming fluid F at the inlet opening 8 under the inlet fluid pressure. In these circumstances, the local fluid pressure decreases below the vapor pressures of dissolved gases in the fluid F, or the vapor pressure of the pumped fluid F itself, so as to rupture the continuity of the fluid F at some particle or solid surface nucleation site and thereby form a cavity or bubble. Such gases, or the vapors of the fluid F, or both, evaporate into that cavity from the surrounding fluid medium.

As the inter-tooth volumes subsequently become more filled, the rising local fluid pressure forces such cavities or bubbles toward collapse causing the pressure and the temperature of the vapors therein to increase. This continues until the volumes of those cavities or bubbles become a very small fraction of their original sizes to finally reach a point of total collapse, and so to result in an acoustic shock wave occurring in a very small volume that dissipates the vapors into the surrounding fluid medium. Such collapses occurring on or near surfaces of the gear teeth 1 can erode them to thereby leave pits at those surfaces which, in occurring repeatedly, can destroy the surfaces of the gear teeth 1.

FIG. 2 illustrates a computational fluid dynamics (CFD) analysis of a gear pump like the gear pump 10 done by CFX Berlin Software GmbH of Berlin, Germany. Although the gears 2, 3 of the gear pump 10 each have nine teeth 1, for example, the gears of the gear pump analyzed in FIG. 2 each have eleven teeth. CFD simulates fluid motion using numerical approaches; therefore, CFD acts as a virtual fluid dynamics simulator. The results show velocities, water vapor (cavitation), and air (aeration) behavior.

Various attempts have been made to address problematic cavitation in gear pumps like the gear pump 10. The cavitation effect in the gear pump 10 can be addressed with precision-machined helical gears 2, 3 generating a smooth opening of the gear mesh. Nevertheless, internal mechanisms within the gear pump 10 can produce localized pressure drops as high as 0.1 bar in water at speeds above 3,000 rpm.

Another attempt is to provide channels on the bearing surfaces beginning adjacent to the mesh location 7 where the gears 2, 3 mesh and, from there, extending along generally opposite directions. Even with such accommodations, however, the rate at which the returning fluid F fills the expanding inter-tooth volume depends on the fluid pressure at the inlet opening 8. Hence, beyond some rotation rate, this fluid inter-tooth volume filling rate will be insufficient to keep up with the expanding inter-tooth volume rate so as to still result in cavitation occurring.

U.S. Pat. No. 7,878,781 assigned to Hamilton Sundstrand Corporation of Rockford, Illinois, discloses yet another attempt to address problematic cavitation in the gear pump 10. A pressurized fluid passageway is provided in at least one of the bearing structures across from the meshing region and extending between surface openings at the bearing surface of that bearing structure that are positioned on opposite sides of an alignment axis in that bearing surface. The surface openings are separated from one another by at least the width of the tooth 1 provided on the pair of gears 2, 3.

Despite these attempts, a need exists for an improved gear pump that addresses the problem of cavitation. In general, cavitation can accelerate the wear and reduce the pumping efficiency and lifespan of gear pump components, particularly gear teeth. Therefore, objects of the present disclosure are to minimize, if not eliminate, cavitation; reduce wear; and increase the efficiency and lifespan of gear pumps. A related object is to significantly reduce or even to eliminate the pressure difference at the limits of the gear pump. Another object is to provide a gear pump that minimizes fuel consumption by reducing energy losses.

SUMMARY OF THE DISCLOSURE

To meet this and other needs, to achieve these and other objects, and in view of its purposes, the present disclosure provides a gear having volume expansion for cavitation reduction in a gear pump mesh. The gear has a gear tooth profile; a body; a plurality of involute gear teeth extending radially outward from the body and including first and second neighboring gear teeth each having a respective tip and a root, the first and second neighboring gear teeth defining a space between them; and a root pocket formed directly into the roots of the gear teeth and in the space between the gear teeth, providing an increased gear root volume and adding trapped fluid compliance while leaving unaltered the gear tooth profile.

Also provided is a gear pump. The gear pump comprises a first gear having (i) a gear tooth profile, (ii) a first body, (iii) a first plurality of involute gear teeth extending radially outward from the first body and including first and second neighboring gear teeth each having a respective tip and a root, the first and second neighboring gear teeth defining a space between them, and (iv) a root pocket formed directly into the roots of the first gear teeth and in the space between the first gear teeth, providing an increased gear root volume and adding trapped fluid compliance while leaving unaltered the gear tooth profile. The gear pump also comprises a second gear being configured to mesh with the first gear in a mesh zone that defines a gear mesh volume that is increased by the root pocket and having a second body and a second plurality of involute gear teeth extending radially outward from the second body. The gear pump further comprises a first gear bearing and a second gear bearing configured to position the first gear and the second gear along a bearing center line, wherein the root pocket does not extend into either the first or the second gear bearing. Finally, the gear pump still further comprises a housing having a fluid inlet and a fluid outlet and in which are disposed the first gear, the second gear, first gear bearing, and the second gear bearing.

It is to be understood that both the foregoing general description and the following detailed description are exemplary, but are not restrictive, of the disclosure.

BRIEF DESCRIPTION OF THE DRAWING

The disclosure is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE DISCLOSURE

In this specification and in the claims that follow, reference will be made to a number of terms which shall be defined to have the following meanings ascribed to them. The term "substantially," as used in this document, is a descriptive term that denotes approximation and means "considerable in extent" or "largely but not wholly that which is specified" and is intended to avoid a strict numerical boundary to the specified parameter. Directional terms as used in this disclosure—for example up, down, right, left, front, back, top, bottom—are made only with reference to the figures as drawn and are not intended to imply absolute orientation.

The term "about" means those amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When a value is described to be about or about equal to a certain number, the value is within ±10% of the number. For example, a value that is about 10 refers to a value between 9 and 11, inclusive. When the term "about" is used in describing a value or an end-point of a range, the disclosure should be understood to include the specific value or end-point. Whether or not a numerical value or end-point of a range in the specification recites "about," the numerical value or end-point of a range is intended to include two embodiments: one modified by "about" and one not modified by "about." It will be further understood that the end-points of each of the ranges are significant both in relation to the other end-point and independently of the other end-point.

The term "about" further references all terms in the range unless otherwise stated. For example, about 1, 2, or 3 is equivalent to about 1, about 2, or about 3, and further comprises from about 1-3, from about 1-2, and from about 2-3. Specific and preferred values disclosed for components and steps, and ranges thereof, are for illustration only; they do not exclude other defined values or other values within defined ranges. The components and method steps of the disclosure include those having any value or any combination of the values, specific values, more specific values, and preferred values described.

The indefinite article "a" or "an" and its corresponding definite article "the" as used in this disclosure means at least one, or one or more, unless specified otherwise. "Include," "includes," "including," "have," "has," "having," "comprise," "comprises," "comprising," or like terms mean encompassing but not limited to, that is, inclusive and not exclusive.

Overview of Gear Pump

Figure 3:
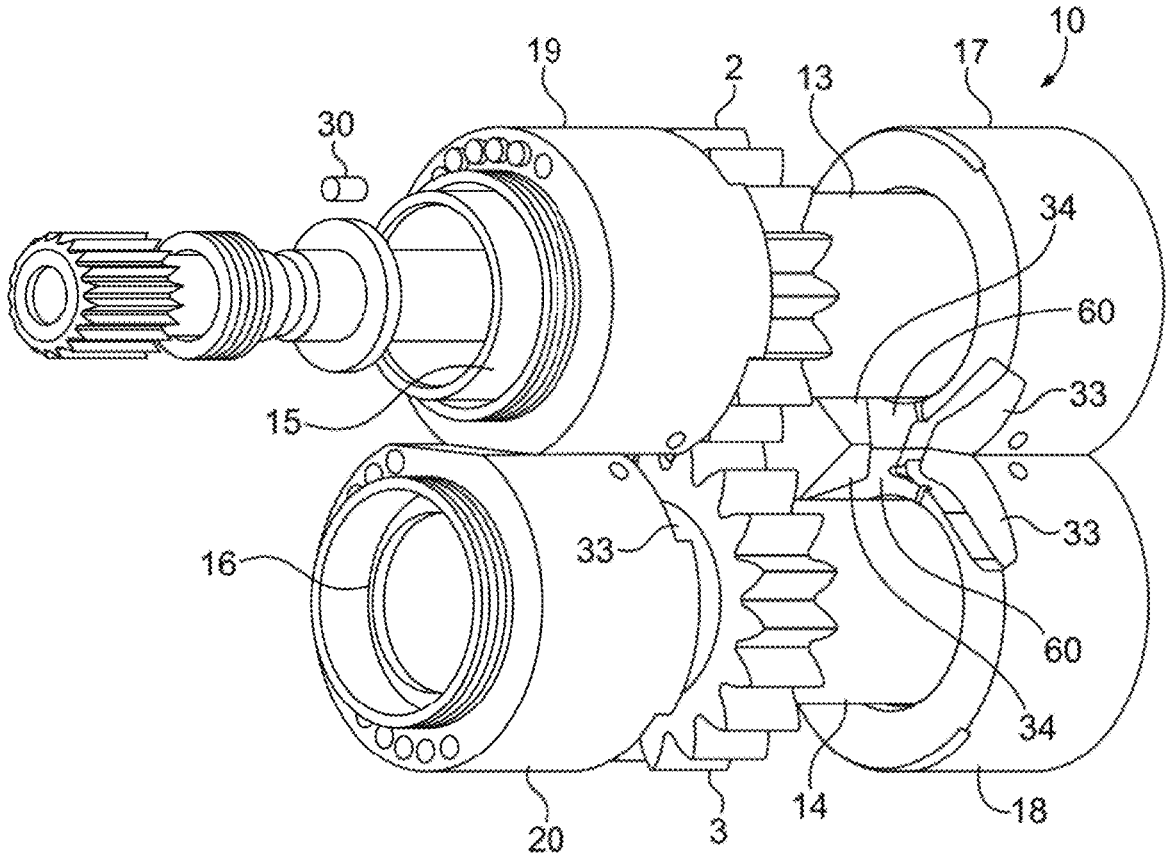
FIG. 3 (PRIOR ART)
FIG. 3 is a perspective view of a conventional high pressure gear pump illustrating the general layout of the gear pump.

FIG. 3 is a perspective view of the gear pump 10 typical of an aerospace fluid pump that operates to pump fuel, lubricant, or other fluids. Aircraft engines include a main fuel pump, for example, that is at the heart of their regulation system. Such pumps supply fuel to the combustion chamber by pumping the necessary flow from the fuel tanks. The output flow from these fuel pumps is also used as a hydraulic fluid to operate actuators, like those used to open air flow discharge gates from the engine core flow to the fan flow.

Figure 1:
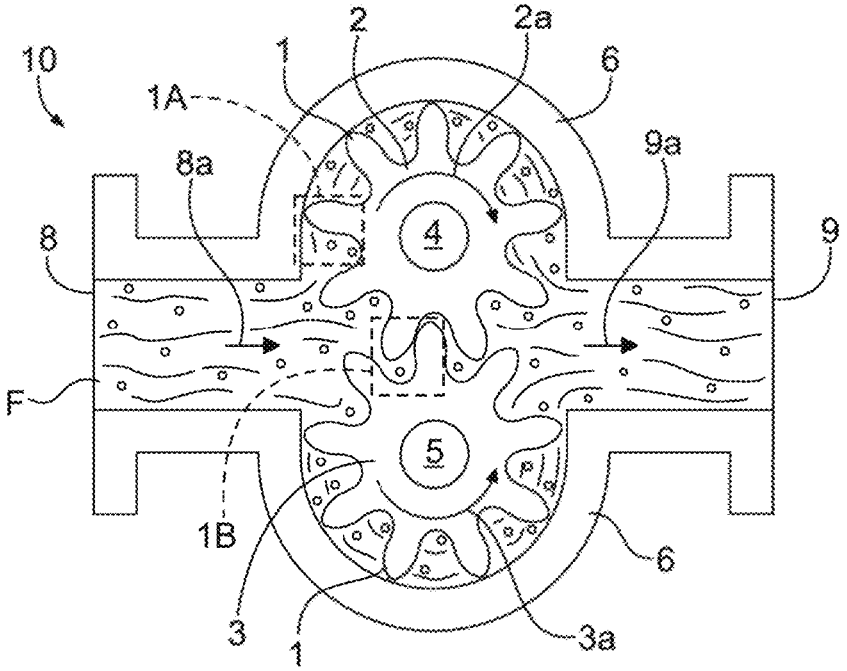
FIG. 1 (PRIOR ART)
FIG. 1 is a cross section side view schematic diagram showing a conventional gear pump.
Figure 1A:
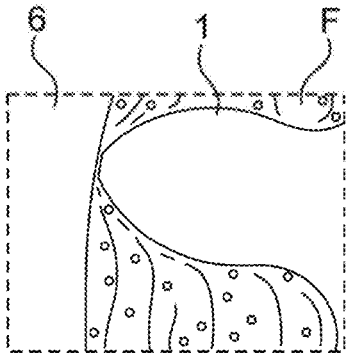
FIG. 1A illustrates one common cavitation location in the gear pump shown in FIG. 1, where the teeth of the first gear approach the walls of the housing of the gear pump, in an enlarged view of the dashed area 1A shown in FIG. 1.
Figure 1B:
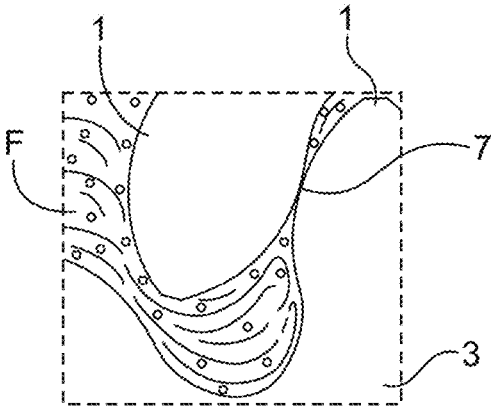
FIG. 1B illustrates another common cavitation location in the gear pump shown in FIG. 1, namely proximate the mesh location, in an enlarged view of the dashed area 1B shown in FIG. 1.
Figure 2:
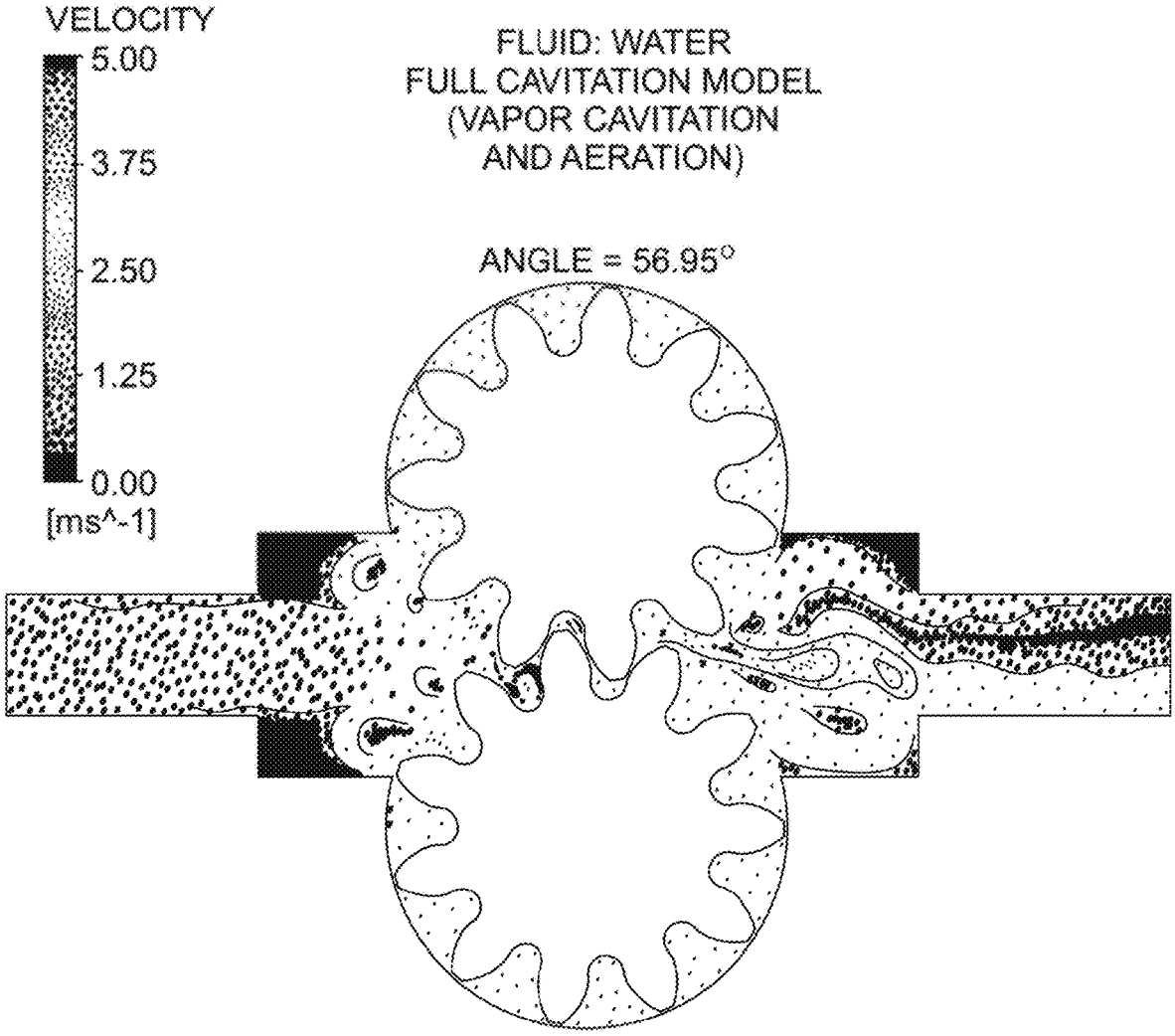
FIG. 2 (PRIOR ART)
FIG. 2 illustrates a computational fluid dynamics (CFD) analysis of a gear pump like the conventional gear pump shown in FIG. 1.

FIG. 3 illustrates the general layout of the high pressure gear pump 10, which is described in U.S. Pat. No. 10,094,291 assigned to Safran Aircraft Engines of Paris, France. The gear pump 10 includes the first gear 2 and the second gear 3 that mesh together and discharge fuel between their teeth 1 to achieve pumping. The first gear 2 is driven by the gear shaft 4 (see FIG. 1). As shown in FIG. 3, each of the gears (or pinions) 2 and 3 have stub shafts 13, 14 and 15, 16 at its two opposite sides, the first of which at the right in FIG. 3 are supported by first bearings 17, 18 respectively, called fixed or stationary bearings with first gaps, and the second at the left in FIG. 3 are supported by second bearings called mobile or floating bearings 19, 20 with second gaps. These bearings 17, 18, 19, and 20 are all smooth bearings, but the fixed bearings 17 and 18 are retained with a smaller gap in the housing 6 than the mobile bearings 19 and 20, and can thus be displaced in the axial direction to squeeze the gears 2 and 3 and reduce gaps that could enable recirculation of the pumped fluid towards low pressures.

Satisfactory operation of the high pressure gear pump 10 depends on a sufficiently good seal among its different components. It is essential to limit leaks of pumped fluid outside the housing 6, and also around the gears 2 and 3 in recirculation to the inlet opening 8 of the gear pump 10. Leaks by recirculation around the gears 2 and 3 are minimized by a plurality of springs 30 to push the mobile bearings 19 and 20 toward the gears 2 and 3, which is referred to as squeezing of the gears 2 and 3.

Figure 4:
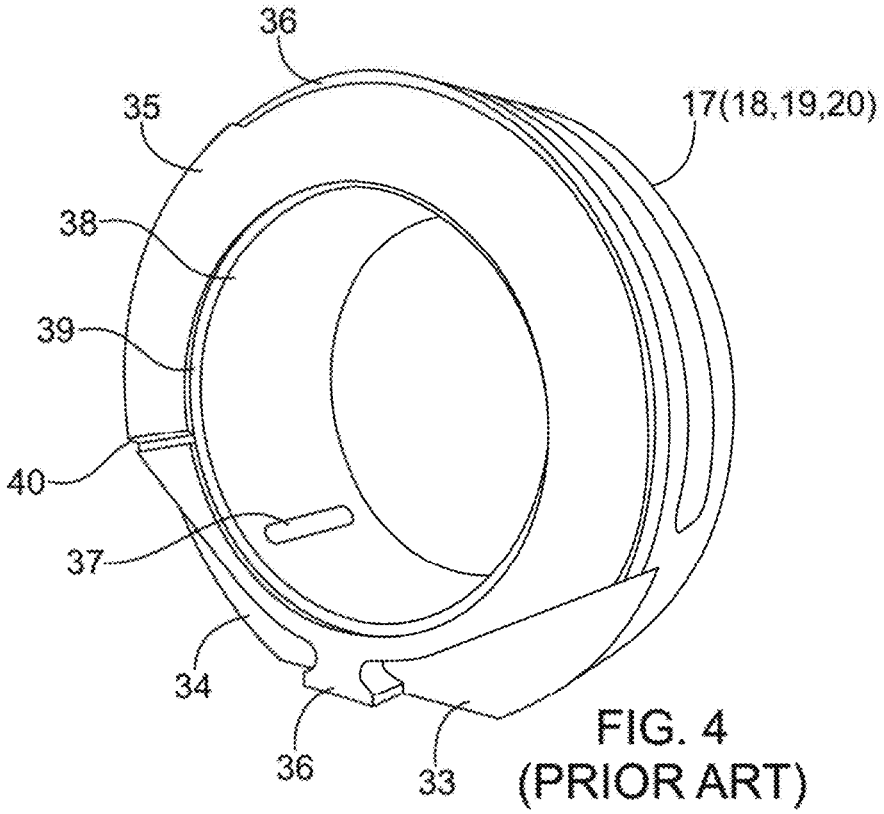
FIG. 4 (PRIOR ART)
FIG. 4 is a perspective view of one of the bearings of the high pressure gear pump shown in FIG. 3.

Another criterion for satisfactory operation of the gear pump 10 will now be described with reference to FIGS. 4 and 5. Friction among bearings 17 to 20, gears 2 and 3, and their stub shafts 13 to 16 is avoided by fluid hydrodynamic lift layers formed by recirculation of the pumped fluid. Several relief patterns are excavated in each bearing 17 to 20, including a high pressure dish 33 and a low pressure dish 34 at the periphery of the inner axial face 35 (close to gears 2 and 3), on each side of a separation flange 60. The dishes 33 and 34 are in communication with adjacent fluid volumes at the inlet opening 8 and the outlet opening 9 to the gear pump 10. The high pressure dish 33 communicates with a curved high pressure groove 36 that opens up on its inner axial face 35, and on a high pressure groove 37 through a drilling not shown, that opens up on an inner radial face 38 of bearings 17 to 20. A low pressure groove 39 extends to the junction of the inner axial face 35 and the inner radial face 38 and communicates with the low pressure dish 34 through a collective groove 40. In bearings 17 to 20 made in this manner, operation of the gear pump 10 thus maintains fluid circulation from the high pressure dish 33 to the low pressure dish 34, providing dynamic lubrication of the bearings 17 to 20 by creating hydrodynamic layers on the inner axial face 35 and the inner radial face 38. Therefore, the stub shafts 13 to 16 are supported by these hydrodynamic layers in the inner radial faces 38 that occupy the gaps, and the hydrodynamic layers on the inner axial faces 35 form adjacent to the flanks of the gears 2 and 3, holding them slightly separated from the bearings 17 to 20 and therefore preventing the gaps from being entirely closed, despite the springs 30.

Figure 5:
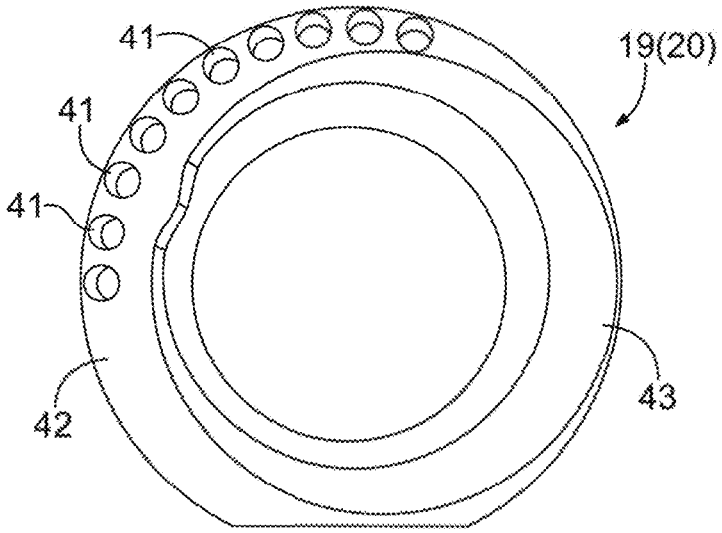
FIG. 5 (PRIOR ART)
FIG. 5 is a front view of one of the mobile or floating bearings of the high pressure gear pump shown in FIGS. 3 and 4.

Thus, as shown in FIG. 5, the mobile bearings 19 and 20, in their known construction, have a special feature at their outer axial face remote from the gears 2 and 3: this face is divided into two crescent shaped portions 42 and 43 that are located in different planes, separated by a shoulder fitted with a seal that exposes the crescent shaped portion 42 to high fluid pressure and the crescent shaped portion 43 to low pressure. The mobile bearings 19 and 20 are held in place at the shoulder separating the crescent shaped portions 42 and 43, in grooves reamed in the housing 6, offset from the rotation axes of the gears 2 and 3. A plurality of springs 30 are compressed between the mobile bearings 19 and 20 and one face of the housing 6. The springs 30 are installed into corresponding compartments 41 only where the crescent shaped portion 42 is largest, over approximately a quarter of the circumference of the mobile bearings 19 and 20. The thrust in the axial direction is then unbalanced and comprises a moment about a transverse axis of the mobile bearings 19 and 20, so as to balance an opposing moment created by pressure differences in the pumped fluid on the inner axial faces 35; therefore, there is no tilting of the mobile bearings 19 and 20 about this axis, so that they remain coaxial with the stub shafts 15 and 16 that they support, despite assembly gaps of the mobile bearings 19 and 20 in the housing 6.

Channels on Bearing Surfaces

As recognized above, one attempt to address the problem of cavitation in gear pumps is to provide channels on the bearing surfaces. U.S. Pat. No. 9,932,980 assigned to Woodward, Inc. of Fort Collins, Colorado, provides a specific example of this attempt. The '980 patent discloses gear pump bearings having inlet and discharge relief cuts in the face of the floating (mobile) and stationary (fixed) bearings. Such relief cuts can allow the fluid being pumped to flow out of the gear mesh to the top and bottom of the gear on the discharge side and flow into the gear mesh from the top and bottom of the gear on the inlet side. Such relief cuts leave some of the bearing material near the center line between the inlet and discharge to create a bearing dam. The bearing dam substantially seals the inlet from the discharge side to maintain pumping efficiency. In some embodiments, the shape of the bearing dam can have a significant impact on gear venting and filling, and therefore may impact the cavitation performance of the gear pump. In summary, the gear pump described in the '980 patent includes a bearing dam with a geometry that ostensibly reduces fluid cavitation and the damage that can result.

Figure 6A:
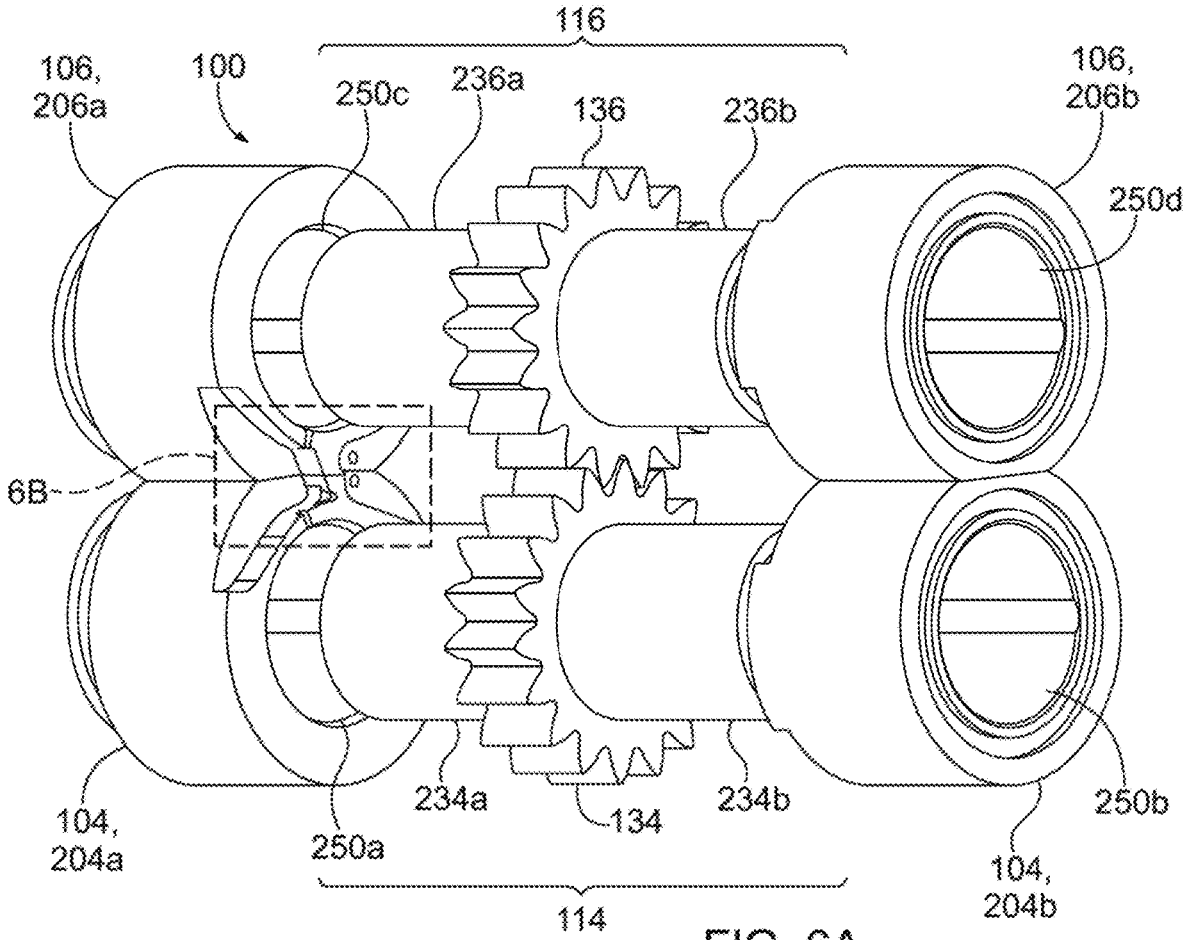
FIG. 6A (PRIOR ART)
FIG. 6A shows a front offset angle perspective view of an example gear pump assembly.

More specifically, the '980 patent describes and illustrates an example gear pump assembly 100. FIG. 6A shows a front offset angle perspective view of the assembly 100. As shown in FIG. 6A, a driving gear bearing 104 includes a driving gear bearing half 204*a* and a driving gear bearing half 204*b*. A driving gear 114 includes driving gear teeth 134, a central shaft portion 234*a* (e.g., a journal) extending axially from the driving gear teeth 134, and a central shaft portion 234*b* extending axially from the driving gear teeth 134 opposite the central shaft portion 234*a*. The driving gear bearing half 204*a* includes a bore 250*a*, and the driving gear bearing half 204*b* includes a bore 250*b*. The bore 250*a* is formed to accept insertion of and rotationally support the central shaft portion 234*a*, and the bore 250*b* is formed to accept insertion of and rotationally support the central shaft portion 234*b*, when the assembly 100 is in its assembled form.

As shown in FIG. 6A, a driven gear bearing 106 includes a driven gear bearing half 206*a* and a driven gear bearing half 206*b*. A driven gear 116 includes driven gear teeth 136, a central shaft portion 236*a* extending axially from the driven gear teeth 136, and a central shaft portion 236*b* extending axially from the driven gear teeth 136 opposite the central shaft portion 236*a*. The driven gear bearing half 206*a* includes a bore 250*c*, and the driven gear bearing half 206*b* includes a bore 250*d*. The bore 250*c* is formed to accept insertion of and rotationally support the central shaft portion 236*a*, and the bore 250*d* is formed to accept insertion of and rotationally support the central shaft portion 236*b*, when the assembly 100 is in its assembled form.

Figure 6B:
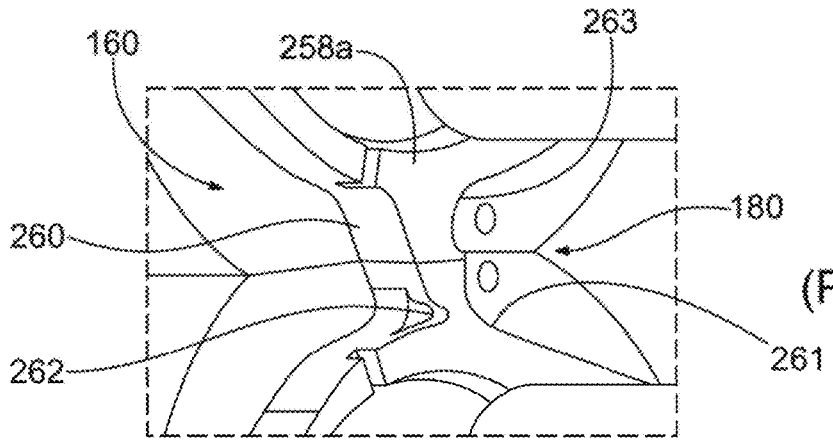
FIG. 6B (PRIOR ART)
FIG. 6B is an enlarged view of the bearing dam half that is highlighted in the dashed area 6B shown in FIG. 6A.

The assembly 100 includes the central fluid dam half 258*a* within the area 6B in FIG. 6A proximate the bores 250*a* and 250*c* in the bearing half 204*a* and the bearing half 206*a*, respectively. FIG. 6B is an enlarged view of the bearing dam half 258*a* shown in that area. A corresponding central fluid dam half (not shown) is provided proximate the bores 250*b* and 250*d* in the bearing half 204*b* and the bearing half 206*b*, respectively. Together, the central fluid dam half 258*a* and the corresponding central fluid dam half form the bearing dam.

Referring now to FIG. 6B, the central fluid dam half 258*a* of the bearing dam includes an inlet face 260 and an outlet face 261. The inlet face 260 includes a slot 262 formed as a relief cut in the inlet face 260. The outlet face 261 includes a vent 263 formed as a relief cut in the outlet face 261. In the assembled form of the assembly 100, the central fluid dam halves, the driving gear teeth 134, and the driven gear teeth 136 provide a barrier that substantially blocks the flow of fluid between the fluid inlet cavity 160 and the fluid discharge cavity 180 along the bearing split line across the bearing center line. The configuration of the inlet face 260, the outlet face 261, the slot 262, and the vent 263 is designed to address cavitation.

Gear Tooth Geometry

Figure 7:
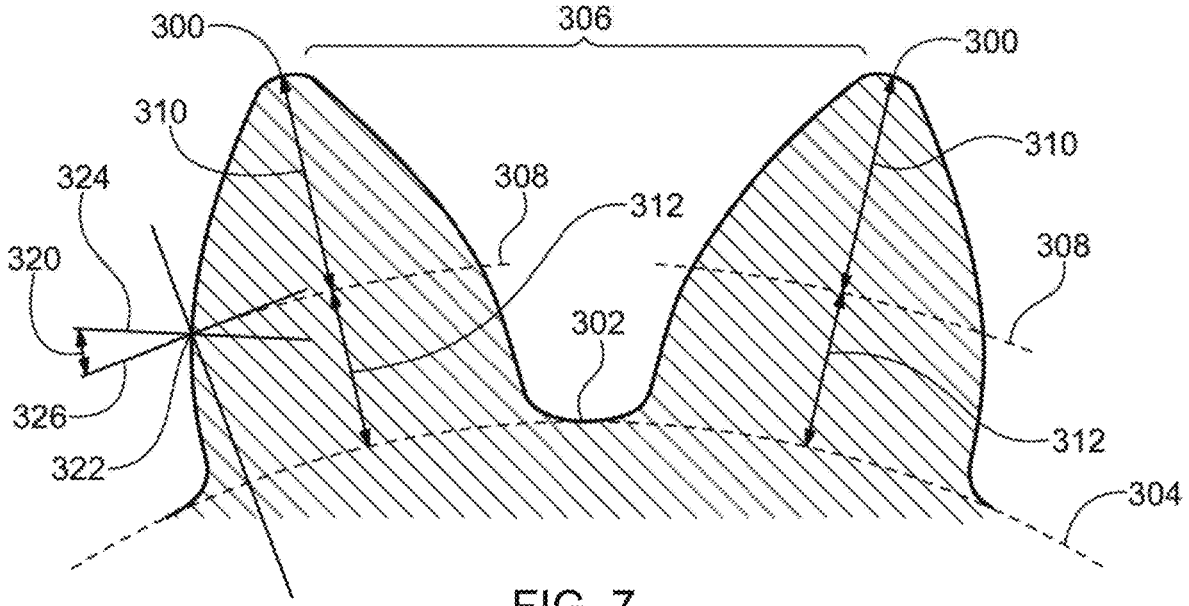
FIG. 7 (PRIOR ART)
FIG. 7 is a side view of a collection of example gear teeth.

FIG. 7 is a side view of a collection of example gear teeth 300. In some embodiments, the gear teeth 300 can represent the driving gear teeth 134 and/or the driven gear teeth 136 of the example gear pump assembly 100.

The gear teeth 300 extend radially from a gear 302. In some embodiments, the gear 302 can be the driving gear 114 or the driven gear 116. The gear 302 has a root diameter 304, which is the diameter at the base of a tooth space 306. The gear 302 also includes a pitch circle 308. In some embodiments, the pitch circle 308 can be the circle derived from the number of the gear teeth 300 and a predetermined diametral or circular pitch, and can be the circle on which spacing or tooth profiles is established and from which the tooth proportions can be constructed.

One of the fundamentals of gear design is the profile of the gear tooth (i.e., the gear tooth profile). The profile is the shape of the gear tooth curve and is measured from the root to the tip of the gear tooth. The functional, or operating, portion of the profile is the area that is in actual contact during tooth mesh. Gears generally have an involute curve tooth profile. This involute curve helps the gears transmit power smoothly during the rolling action. The tooth thickness, diametral pitch, and pressure angle all help determine the gear tooth profile. These factors are determined by the desired contact ratio between mating parts of the gear. The gear tooth profile also varies by the number of teeth on the gear such that the larger the amount of teeth the straighter the profile of the gear eventually forming what is called a rack gear.

Each of the gear teeth 300 includes an addendum 310 and a dedendum 312. The addendum 310 is the height by which the gear tooth 300 projects beyond the pitch circle 308; the dedendum 312 is the depth of the tooth space 306 between the pitch circle 308 and the root diameter 304. Each of the gear teeth 300 also includes a pressure angle 320. The pressure angle 320 is the angle at a pitch point 322 on the pitch circle 308 between the line of pressure which is normal to the tooth surface at the pitch point 322, and the plane tangent to the pitch circle 308. In involute teeth such as the gear teeth 300, the pressure angle 320 can be also described as the angle between a line of action 324 and a line 326 tangent to the pitch circle 308.

The gear teeth 300 of the gear 302 illustrated in FIG. 7 depict a standard full fillet root profile. As defined in this document, a "standard full fillet root profile" is that which provides a constant radius which extends in a continuous arc from one tooth 300 to the next tooth 300. The typical geometry for a spur gear tooth root is a full fillet which is tangent to the involute tooth profile and simultaneously tangent to the root diameter. The lowest point of the constant radius fillet establishes the root diameter. In the case of hobbed gears, the geometry is generated by the path the tool tip follows as the teeth 300 are cut. For form ground teeth, the radius is formed on the extremity of the grinding wheel. The adjacent sides of two teeth 300 and the root between them are formed at the same time by the grinding wheel that conforms to the net finished profile of the space between the teeth 300.

In contrast to the standard full fillet root profile, U.S. Pat. No. 9,057,372 assigned to Hamilton Sundstrand Corporation of Windsor Locks, Connecticut, discloses a modified gear root profile or geometry. The modified gear root profile provides a desired enlarged carry-over fluid volume as compared to the standard full fillet root profile to mitigate the effects of fluid displacement. Ostensibly, the effects from the enlarged carry-over volume of the modified gear root geometry tend to reduce the phenomenon of cavitation within the gear mesh zone. Because other factors can be affected by profile changes such as leakage across the pump thus reducing volumetric efficiency, however, this approach has limited effectiveness.

The geometry of the gear teeth 300 will be relevant to the discussion below.

Root Pockets

Figure 8:
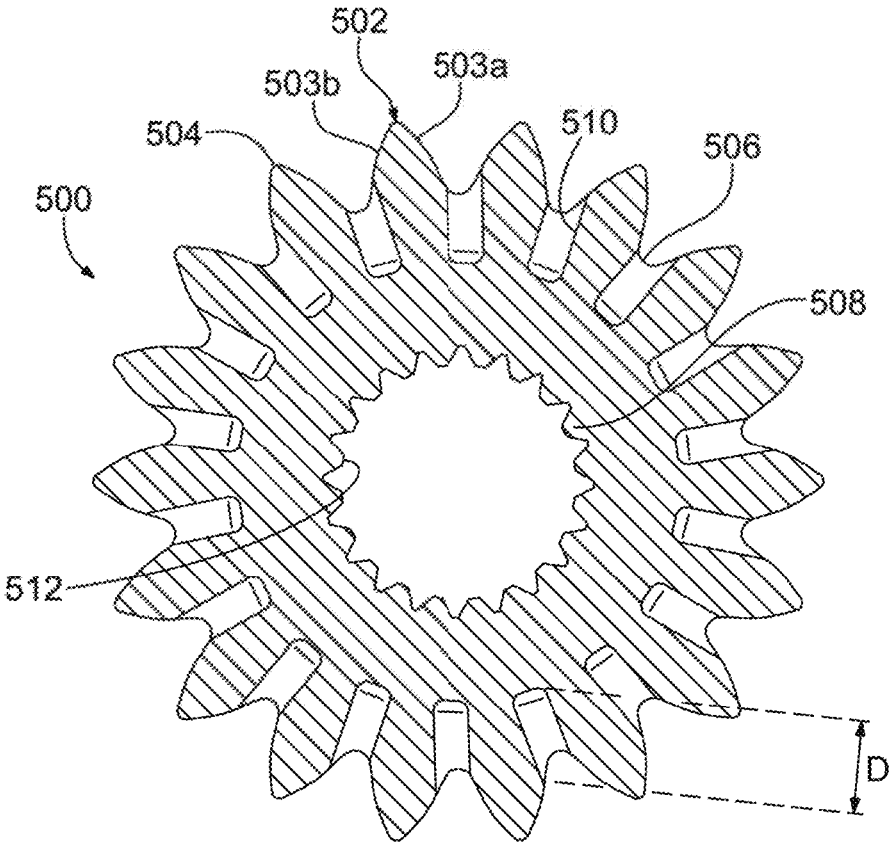
FIG. 8 is side view schematic diagram showing a gear as modified by machining cavities or pockets directly into the roots of the gear teeth according to the present disclosure.
Figure 9:
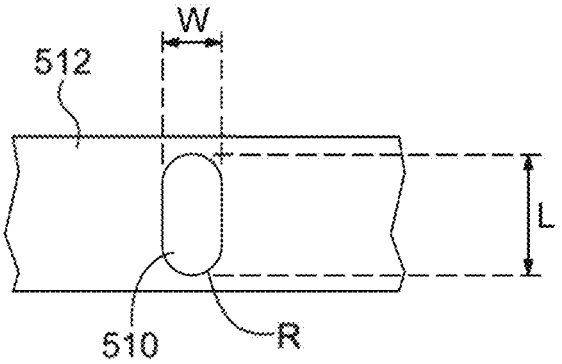
FIG. 9 is a schematic diagram illustrating an example, oval shape and example dimensions for the pockets shown in FIG. 8.
Figure 10:
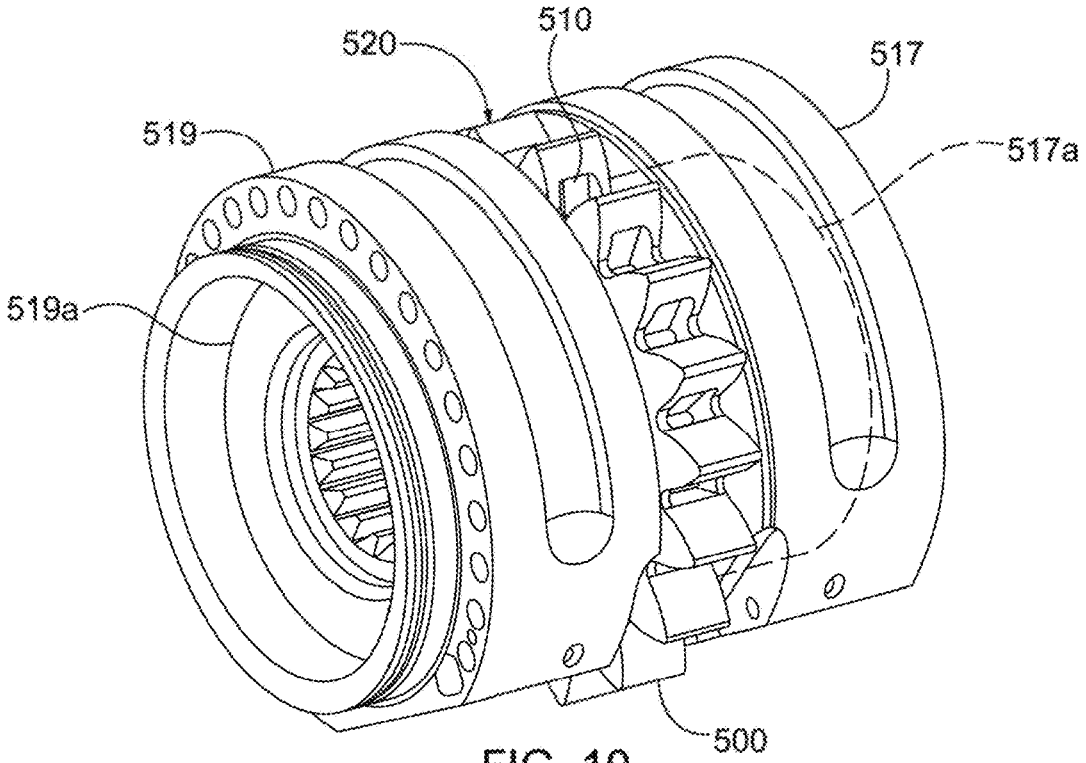
FIG. 10 is a perspective view of a portion of a gear pump, including the gear having the pockets shown in FIG. 8, located between a stationary or fixed bearing and a floating or mobile bearing.
Figure 11A:
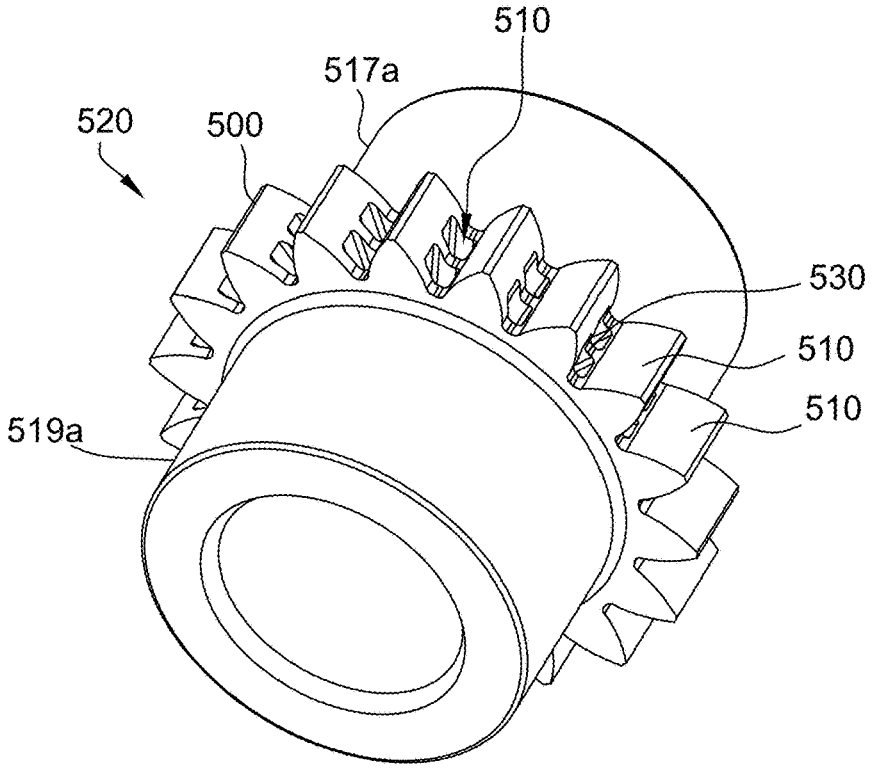
FIGS. 11A-D are illustrations of a portion of a gear having a pocket with a beam across the center of the pocket.
Figure 11B:
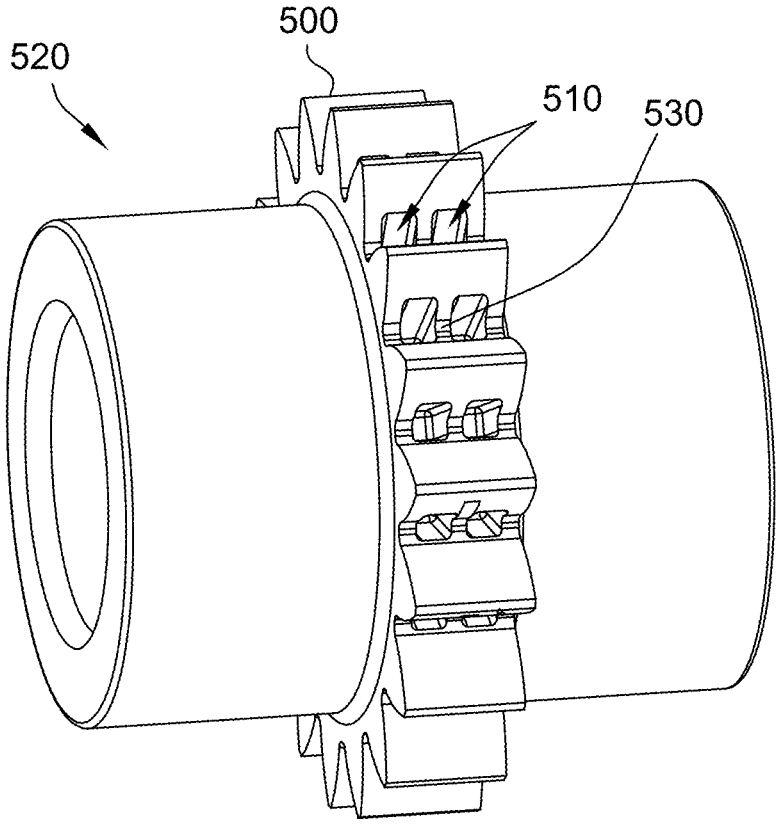
Figure 11C:
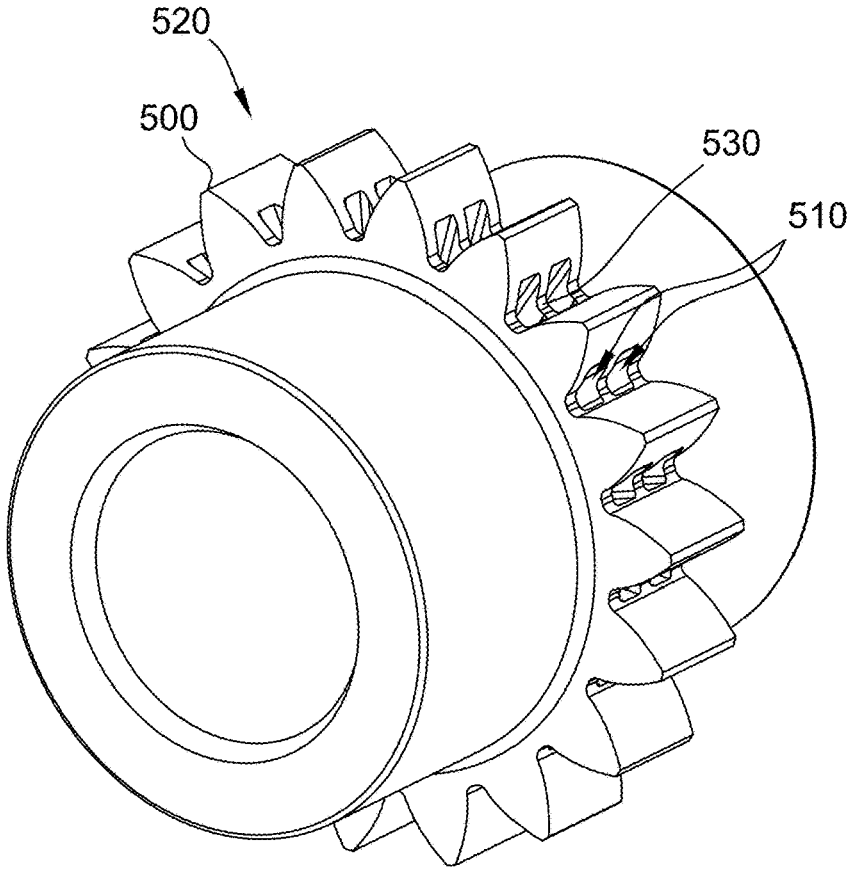
Figure 11D:
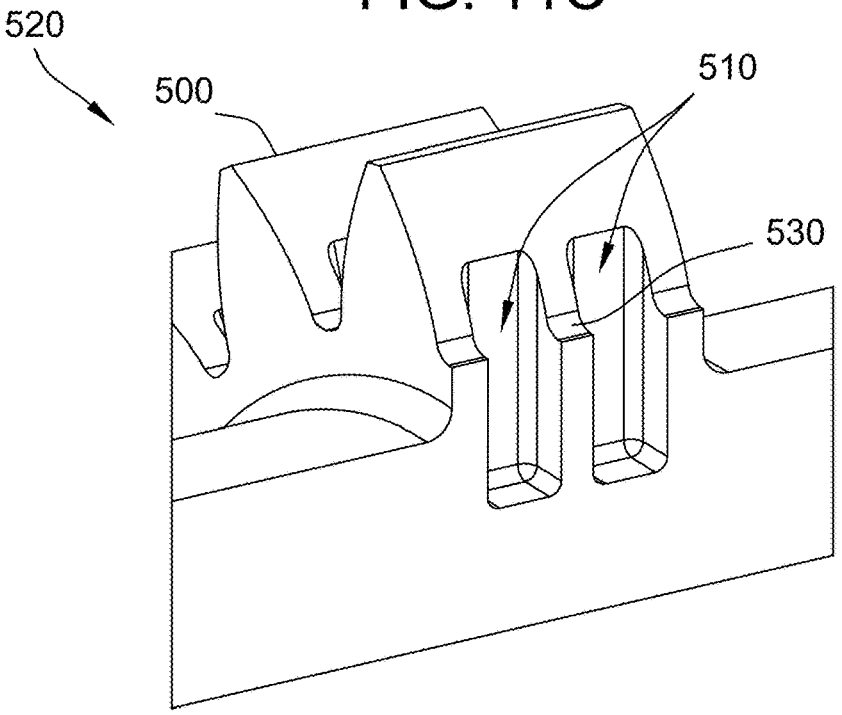

As described above, various attempts have been made to address problematic cavitation in gear pumps like the gear pump 10. A need exists, despite these attempts, for an improved gear pump 10 that addresses the problem of cavitation. That need is met, according to the present disclosure and as illustrated in FIGS. 8, 9, and 10, by increasing the gear root volume and, thereby, adding trapped fluid compliance. This disclosure incorporates an added feature to a standard gear pump 10 which increases the overall fluid volume, beyond that of a standard or traditional gear profile, inside the gear mesh. The feature addresses the problems associated with gear mesh venting, which can typically result in cavitation damage as well as gear journal failures, and reduces cavitation effects and damaging pressure spikes.

The added volume is accomplished, as illustrated in FIG. 8, by modifying a gear 500 having a plurality of teeth 502, each tooth 502 having a contact side 503*a*, a non-contact side 503*b*, a tip 504, and a root 506, extending radially outward from a body 512 and a spline 508 formed in the center of the body 512. The gear 500 is modified by machining cavities or pockets 510 directly into the roots 506 of the gear teeth 502. Material is removed from the non-contacting sides 503*b* of the teeth 502, only as shown, to form the pockets 510. Although eighteen gear teeth 502 and pockets 510 are illustrated in the example of FIG. 8, an artisan would recognize that the number of gear teeth 502 and corresponding pockets 510 can be increased or decreased depending upon the application. The gear 500 as modified with the pockets 510 can be incorporated into the gear pump 10, into the gear pump assembly 100, or into another application.

The pockets 510 are shaped to maximize the volume of liquid (e.g., fuel) which will occupy each pocket 510, while taking into account the structural considerations (e.g., the strength requirements) of the gear 500. Thus, a design tradeoff exists: the pockets 510 must be sized and shaped to maximize their volume while minimizing the adverse impact of the pockets on the integrity of the gear 500. As illustrated in FIG. 9, a preferred shape for the pockets 510 is an oval. An oval shape is defined by a curve that is closed and always concave toward the center; a closed curve bounding a convex domain. Common objects like a football or an egg have oval-shaped sections. Although other shapes are possible for the pockets 510, depending on the application for the gear 500, an oval shape is preferred for at least one particular application.

The application included a gear 500 configured for use in the gear pump 10. The example gear 500 had eighteen teeth 502, a pressure angle of about 30°, a root diameter of about 2.925 inches, a true involute form (TIF) diameter of about 3.059 inches, a circular tooth thickness of about 0.280 inches, and an outside diameter of about 3.700 inches. In this application, the pockets 510 have a depth, D, of about 0.350±0.005 inches; a length, L, of about 0.450±0.001 inches; a width, W, of about 0.179±0.001 inches, and radii of curvature, R, of about 0.060 inches. The radii of curvature help to avoid stress concentrations.

As shown, the pockets 510 do not extend the full length of the gear 500. Thus, the gear 500 has a first length, the root pockets 510 have a second length, and the second length is less than the first length. The gear 500 of the highlighted application has a length between the gear teeth 501, where the pockets 510 are formed, of about 0.700 inches. Therefore, the length of the pockets 510 (about 0.450 inches) is about 65% of the length of the gear 500. Preferably, the length of the pockets 510 is between about 50% and about 80% of the length of the gear 500. More preferably, the length of the pockets 510 is between about 55% and about 75% of the length of the gear 500. Still more preferably, the length of the pockets 510 is between about 60% and about 70% of the length of the gear 500.

It is important for the gear root plunge cuts that form the pockets 510 to increase the overall gear mesh volume while using existing gear profiles. The intent is to place the pockets 510 in such a way as to avoid contact with the working portion of the involute form of the gear 500 thus avoiding alterations to the normal gear profile. FIG. 10 illustrates a portion of a gear pump 520, including the gear 500 having the pockets 510, located between a stationary or fixed bearing 517 (which is positioned on a fixed gear journal 517*a*) and a mobile or floating bearing 519 (which is positioned on a floating gear journal 519*a*). By assuring that the pockets 510 do not extend the full length of the gear 500 and leaving the gear profiles in their original form at the points where the gear 500 contacts the bearings 517 and 519, no alterations to the bearings 517, 519 are required. This allows for the faces of the bearings 517 and 519 as well as the gear profiles to be unaffected by implementing the modification to (i.e., incorporating the pockets 510 into) the gear 500. By cutting directly into the root radius without affecting the gear profiles, a considerably larger amount of volume can be added to the trapped fluid. Especially for a large gear pump 10, this allows for a much more effective volume increase than can be achieved by conventional attempts to address problematic cavitation in gear pumps, thus minimizing the effect of the trapped volume changes without the deleterious effects of an altered profile.

The design tradeoff represented by the disclosed size and shape of the pockets 510 is just one example. Those skilled in the art should recognize that other configurations, which include multiple pockets, might achieve the best design tradeoff in different applications. One alternative shape for the pockets 510 is shown in FIGS. 11A-D include a beam 530 across the center of one or more of the pockets 510. The beam 530 can extend partially or fully into the depth of the pocket 510; full extension would essentially divide the pocket 510 into two, separate pockets while maximizing the strength of the gear 500. The beam 530 can be added for structural considerations, thus trading a small amount of volume for added gear strength.

Comparative Testing

A significant amount of testing has been done to identify and characterize the cavitation problem addressed by the present disclosure, apply conventional approaches in unsuccessful attempts to solve that problem, and achieve and confirm success with the gear 500 as modified by machining cavities or pockets 510 directly into the roots 506 of the gear teeth 502. Initial tests were conducted on the Model MFP-590 main fuel pump design, which has a conventional bearing design 550 with vent cuts or bearing channels 552, 554, and 556 in the driven bearing 560 and in the driver bearing 562 like the channels disclosed in the '980 patent and discussed above. The Model MFP-590 fuel pump is relatively large in size, has relatively high gear tip speeds, and operates at relatively high pressures.

Figure 12:
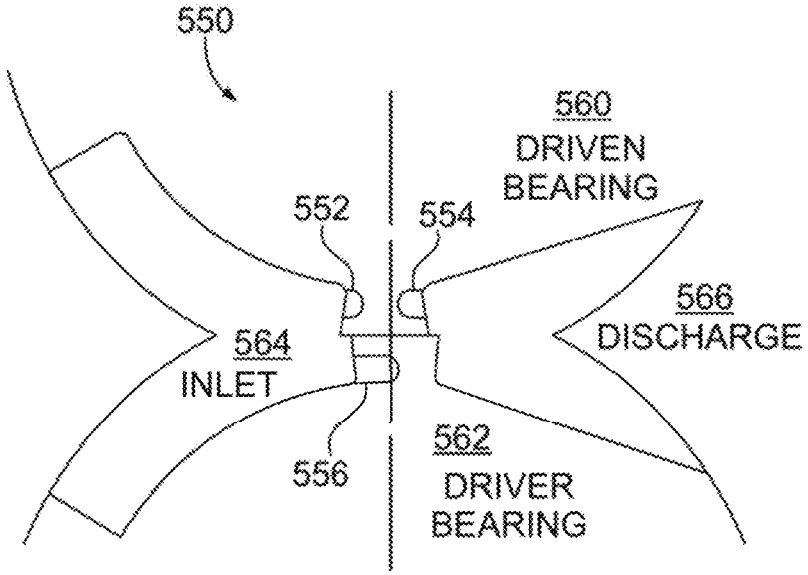
FIG. 12 is a schematic diagram illustrating the conventional bearing design used in the Model MFP-590 main fuel pump.

The conventional bearing design 550 is illustrated in FIG. 12, and has an inlet 564 and an outlet or discharge 566. The initial tests showed, after about eight hours of operation, severe cavitation erosion in both the bearing bridges (breaching the bearing in localized areas) and the bearing journals. The conventional bearing design 550 is required to operate for more than about 5,400 hours without overhaul or service. Therefore, these tests raised concern that the cavitation erosion is life limiting to the component and may result in premature failure.

Figure 13:
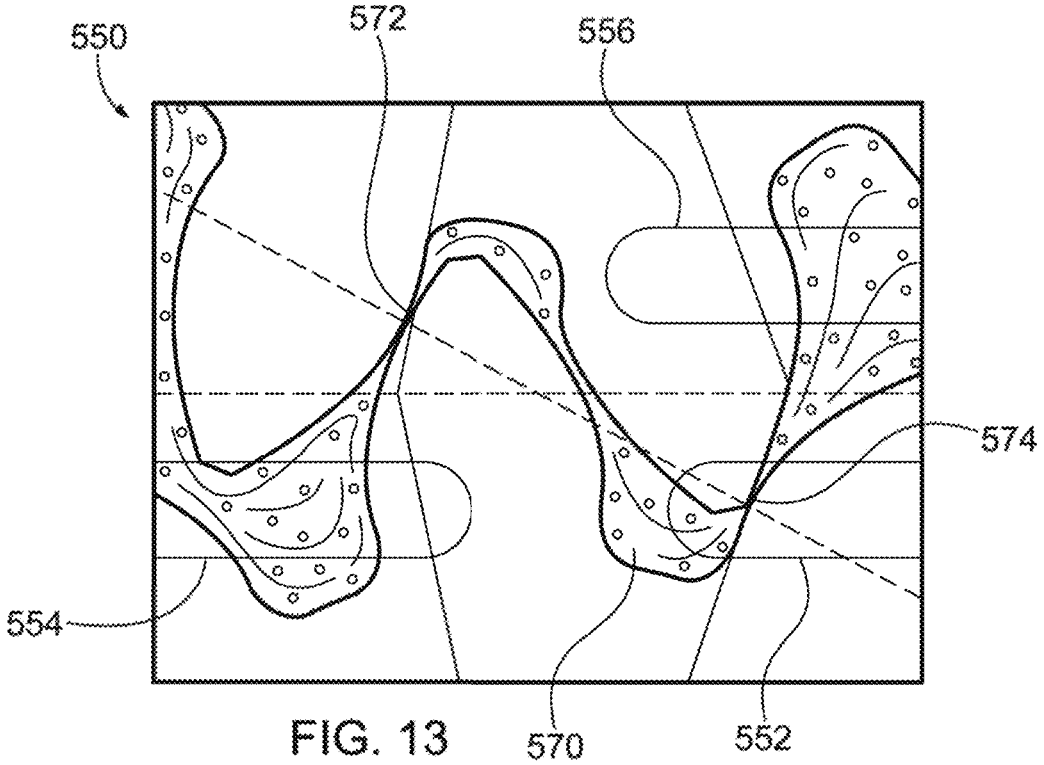
FIG. 13 illustrates an analysis of trapped volume upon gear meshing for the conventional bearing design shown in FIG. 12.

FIG. 13 illustrates an analysis of trapped volume upon gear meshing for the conventional bearing design 550 shown in FIG. 12, and helps to explain why the conventional bearing design 550 experienced severe cavitation erosion. As the gears rotate in the Model MFP-590 fuel pump, a small amount of fluid volume is carried from the discharge 566 back to the inlet 564 through the mesh. At certain instances during the rotation, a small amount or volume of fluid is trapped (as the trapped fluid 570) in the mesh of the gears between a first seal point 572 and a second seal point 574. The trapped fluid 570 is at high pressure. As the gears change position, so will the volume of the trapped fluid 570—with the trapped fluid 570 under high pressure seeking to escape as high velocity jets of fluid by pushing through the seal points 572, 574. Because the trapped fluid 570 is essentially incompressible, these fast transients in volume change can result in varied oscillations in pressure between the two gears. These are often high energy oscillations which lead to cavitation and subsequent damage to surrounding hardware. The high pressure oscillations can also lead to undesirable motion of the gears, thus further exacerbating the problem. This high energy phenomenon typically manifests itself as physical damage due to cavitation erosion issues within the journal bearings or adjoining faces to the gear profiles.

Figure 14:
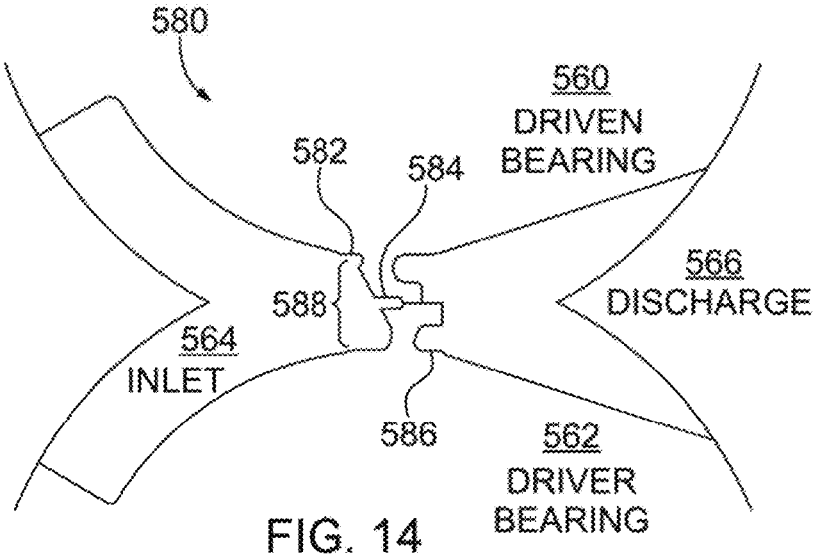
FIG. 14 is a schematic diagram illustrating an aggressive bearing design that was analyzed and tested in the Model MFP-590 pump.

Normal gear pump design practice is to avoid taking material out of the gears; therefore, the conventional design approach to increasing volume is to take material from the bearings. Consistent with this approach and in an effort to address the cavitation problems reflected in the initial tests on the Model MFP-590 fuel pump with the conventional bearing design 550, more aggressive vent cuts or bearing channels were machined into the driven bearing 560 and the driver bearing 562. The aggressive bearing design 580 is illustrated in FIG. 14, and has an inlet 564 and an outlet or discharge 566. As shown in FIG. 14, the aggressive bearing design 580 includes an added notch 582, an added channel 584, and an added discharge vent 586. Further, inlet dam material is removed from the area 588.

Figure 15:
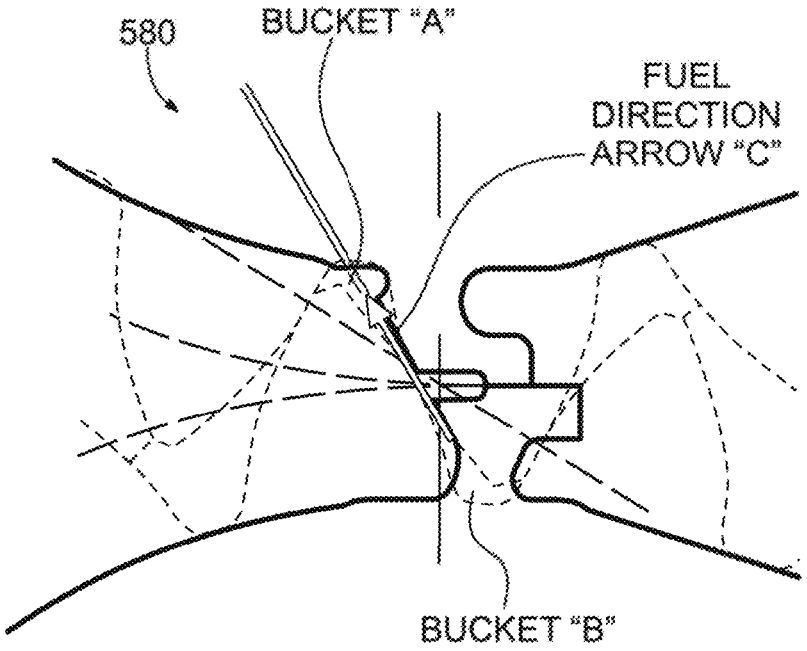
FIG. 15 illustrates an analysis of trapped volume upon gear meshing for the aggressive bearing design shown in FIG. 14.

FIG. 15 illustrates an analysis of trapped volume upon gear meshing for the aggressive bearing design 580 shown in FIG. 14, and helps to explain why the aggressive bearing design 580 was insufficient to avoid cavitation damage. Fuel flows at about 6.25 gallons per minute. At the gear meshing position shown in FIG. 15, fuel in Bucket "B" (at high pressure) is compressed or squeezed into Bucket "A" (at low pressure) via the tight gap between non-contact gear flanks, horizontal slots, and orifices to the discharge port and inlet port. The fuel moves in the direction of arrow "C." This results in high compression, pressure spikes, and cavitation. Even with aggressive vent cuts, sufficient mesh venting could not be achieved without causing excessing leakage across bearing dams.

Thus, conventional design approaches to reduce cavitation damage showed minimal improvement—perhaps due to the unique nature of the Model MFP-590 fuel pump design (relatively large size, relatively high gear tip speeds, and relatively high pressure operation). The need for a new approach was recognized. To help identify alternative ways to reduce cavitation effects and damaging pressure spikes, an analysis of the trapped fluid 570 was completed.

Figure 16:
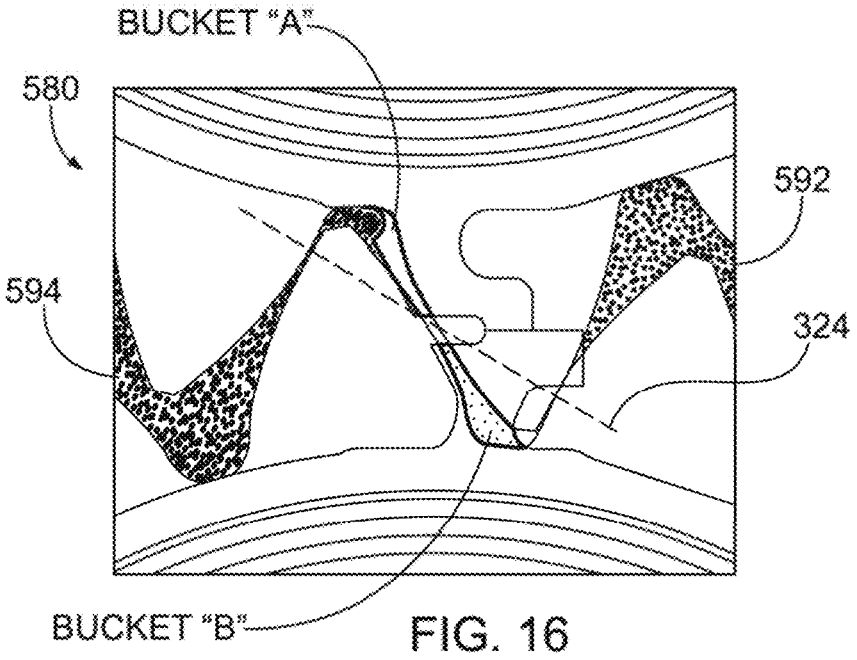
FIG. 16 is a schematic diagram illustrating a trapped volume analysis for a specific fluid fuel traveling through the aggressive bearing design shown in FIG. 14.

FIG. 16 is a schematic diagram illustrating a trapped volume analysis for a specific fluid fuel traveling through the aggressive bearing design 580 shown in FIG. 14. The analysis was done for a fluid fuel having the following properties: a specific gravity of 0.818, a discharge coefficient of 0.75, and a bulk modulus of 150,000 PSIG. PSIG refers to the gauge pressure, expressed in pounds per square inch gauge. It is a unit of pressure relative to the ambient pressure or atmospheric pressure, and measures pressure without factoring in local atmospheric pressure. The gauge pressure is applied when the pressure inside the system is greater than the atmospheric pressure.

At the gear meshing position shown in FIG. 16, fuel in Bucket "B" (at high pressure) is compressed or squeezed into Bucket "A" (at low pressure). The fuel travels from the HP area 592, which is at a relatively high pressure of about 2,200 PSIG, to the LP area 594, which is at a relatively low pressure of about 200 PSIG (reduced by a factor of ten). Visible in FIG. 16 are the gear teeth positioned over two bearings; the bearings that would appear over the gear teeth are omitted for clarity. The line of action 324 is shown.

Figure 17:
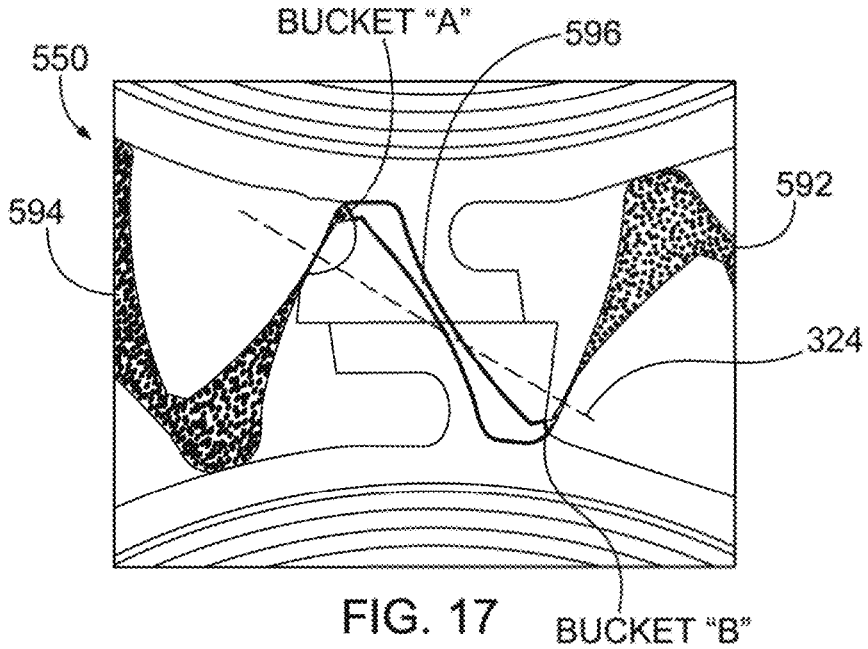
FIG. 17 is a schematic diagram illustrating a trapped volume analysis for the specific fluid fuel traveling through the conventional bearing design shown in FIG. 12.

FIG. 17 is a schematic diagram illustrating a trapped volume analysis for the specific fluid fuel traveling through the conventional bearing design shown in FIG. 12. At the gear meshing position shown in FIG. 17, fuel in Bucket "B" (at high pressure) is compressed or squeezed into Bucket "A" (at low pressure) through the connection 596. The connection 596 provides a small, narrow opening between the HP area 592 and the LP area 594. The fuel travels from the HP area 592 to the LP area 594. Visible in FIG. 17 are the gear teeth positioned over two bearings; the bearings that would appear over the gear teeth are omitted for clarity. The line of action 324 is shown.

The modification of adding the pockets 510 directly into the roots 506 of the gear teeth 502 of the gear 500, as discussed above, reduced cavitation effects and damaging pressure spikes by increasing the gear root volume (adds trapped fluid compliance). The modification significantly reduced the Bucket "B" compression shown in FIGS. 16 and 17 by adding compliance for the compressible fluid fuel. Test results showed a significant reduction in damaging erosion. Specifically, tests of the Model MFP-590 main fuel pump design including the gear 500 with the pockets 510 showed, after about fifty hours of operation, minimal-to-no cavitation erosion. The level of cavitation erosion present is typical of similar, successfully fielded designs and is not life limiting.

Figure 18A:
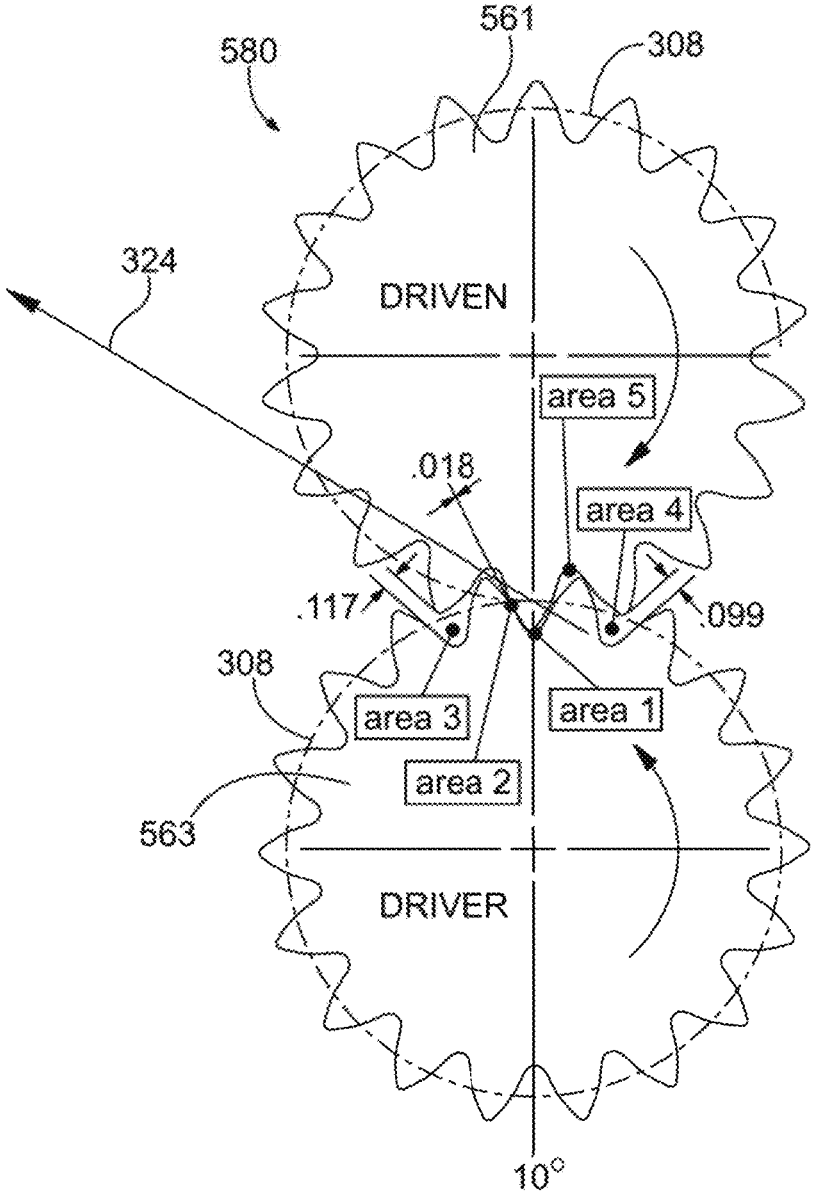
FIG. 18A reflects calculated trapped volumes taken at an angle of rotation of the gears of 10° for the aggressive bearing design shown in FIG. 14.
Figure 18B:
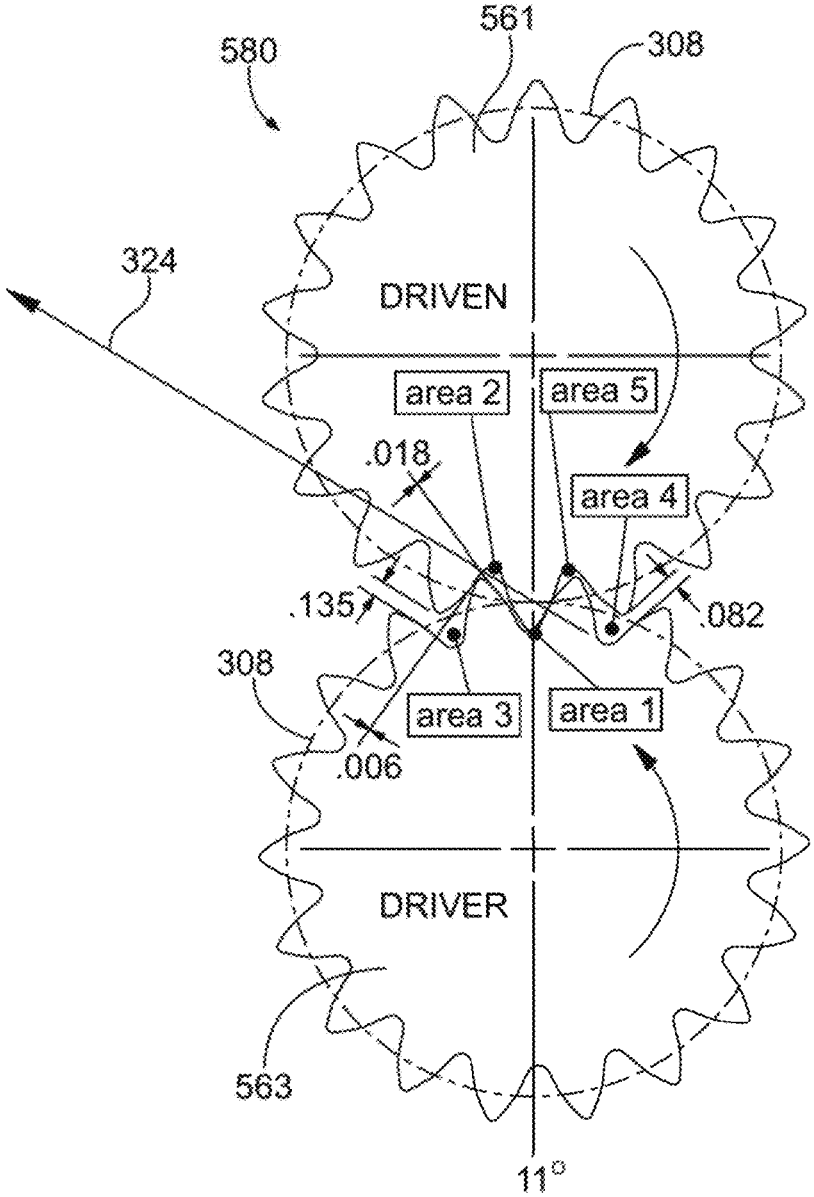
FIG. 18B reflects calculated trapped volumes taken at an angle of rotation of the gears of 11° for the aggressive bearing design shown in FIG. 14.

To quantify the improvement achieved by the modification of adding the pockets 510, additional analytical tests were conducted. An analysis of the aggressive bearing design 580 was done to provide a baseline. FIGS. 18A and 18B reflect the calculated trapped volumes for the aggressive bearing design 580. Given a 360° rotation of the gears and the eighteen gear teeth, a full pass through the mesh covers (360/18=) 20°. The analysis provided calculations over that 20° span in rotational increments of 1°, and identified the lowest volume point in the mesh at between 10° and 11°.

Therefore, FIG. 18A reflects calculations made at an angle of rotation of the gears of 10° and FIG. 18B reflects calculations made at an angle of rotation of the gears of 11° for the aggressive bearing design 580. FIGS. 18A and 18B each depict the driven gear 561, the driver gear 563, the line of action 324, the pitch circle 308, and five areas of trapped fluid volumes: mesh area 1, mesh area 2, mesh area 3, mesh area 4, and mesh area 5. The following table summarizes the trapped mesh areas for the two angles of rotation.

| Area No. | Angle | Trapped Area | | Area No. | Angle | Trapped Area |
|---|---|---|---|---|---|---|
| 1 | 10° | 0.007816 $in^2$ | / | 1 | 11° | 0.007595 $in^2$ |
| 2 | 10° | 0.021640 $in^2$ | / | 2 | 11° | 0.024477 $in^2$ |
| 3 | 10° | 0.060443 $in^2$ | / | 3 | 11° | 0.066470 $in^2$ |
| 4 | 10° | 0.064443 $in^2$ | / | 4 | 11° | 0.058108 $in^2$ |
| 5 | 10° | 0.016354 $in^2$ | / | 5 | 11° | 0.014137 $in^2$ |

The width of the driven gear 561 and of the driver gear 563 is about 0.631 inches. Therefore, the trapped volume in area 1 at an angle of rotation of 10° is 0.007816 $in^2 \times 0.631$ in=0.004932 $in^3$, which is the initial volume (Vi). The trapped volume in area 1 at an angle of rotation of 11° is 0.007595 $in^2 \times 0.631$ in=0.004792 $in^3$, which is the final volume (Vf). The change in volume (dV=Vi−Vf) is 0.004932 $in^3$ minus 0.004792 $in^3$=0.00014 $in^3$. The pressure difference (dP) between the two areas then can be calculated at the lowest volume point in the mesh, assuming that the bulk modulus (B) of the fluid is constant at 150,000 psi, from the equation dP=B(dV/V) as dP=150,000 psi (0.00014 $in^3$/0.004932 $in^3$)=4,258 PSID. (PSID stands for "pounds per square inch differential," and is used when measuring pressure relative to something other than atmospheric pressure.)

An analysis of the improvement achieved by the modification of adding the pockets 510 was done to provide a comparison to the baseline of the aggressive bearing design 580. The pockets 510 added a volume of 0.0295 $in^3$. Therefore, the trapped volume in area 1 at an angle of rotation of 10° is 0.004932 $in^3$+0.0295 $in^3$=0.03443 $in^3$. The trapped volume in area 1 at an angle of rotation of 11° is 0.004792 $in^3$+0.0295 $in^3$=0.03429 $in^3$. The change in volume (dV=Vi−Vf) is 0.03443 $in^3$ minus 0.03429 $in^3$=0.00014 $in^3$. The pressure difference (dP) between the two areas then can be calculated at the lowest volume point in the mesh, assuming that the bulk modulus (B) of the fluid is constant at 150,000 psi, from the equation dP=B(dV/V) as dP=150,000 psi (0.00014 $in^3$/0.03443 $in^3$)=610 PSID. Thus, the addition of the pockets 510 reduced the gear mesh trapped volume compression by a factor of about seven (4,258/610).

The amount of volume increase can also be calculated for the modification of adding the pockets 510 in comparison to the baseline of the aggressive bearing design 580. The trapped volume in area 1 at an angle of rotation of 10° is 0.004932 $in^3$ for the aggressive bearing design 580 and 0.03443 $in^3$ for the modification of adding the pockets 510. Thus, the modification increased the trapped volume by almost 600% ((0.03443−0.0049320)/0.004932×100=598%). The trapped volume in area 1 at an angle of rotation of 11° is 0.004792 $in^3$ for the aggressive bearing design 580 and 0.03429 $in^3$ for the modification of adding the pockets 510. Thus, the modification again increased the trapped volume by about 600% ((0.03429−0.004792)/0.004792×100=616%).

Because the change in volume is fixed, the adverse effects of changes can be minimized by increasing the overall volume, thus making the fixed compression a smaller percentage of the total volume. The modification of adding the pockets 510 increases the overall volume. Therefore, the modification reduces pressure spikes, and thus reduces the overall cavitation of the fluid.

The improvement achieved by the modification of adding the pockets 510, in comparison to the baseline of the aggressive bearing design 580, can also be measured by the effect of the modification on both pressure ripple and gear stress. The pressure ripple can be calculated as the pressure fluctuation or amplitude of pressure deflection up (positive) or down (negative) divided by the total system pressure times 100. Therefore, for example, if the total pressure were 200 psi and the pressure were to fluctuate by 10 psi then the pressure ripple would be 5%.

Figure 19A:
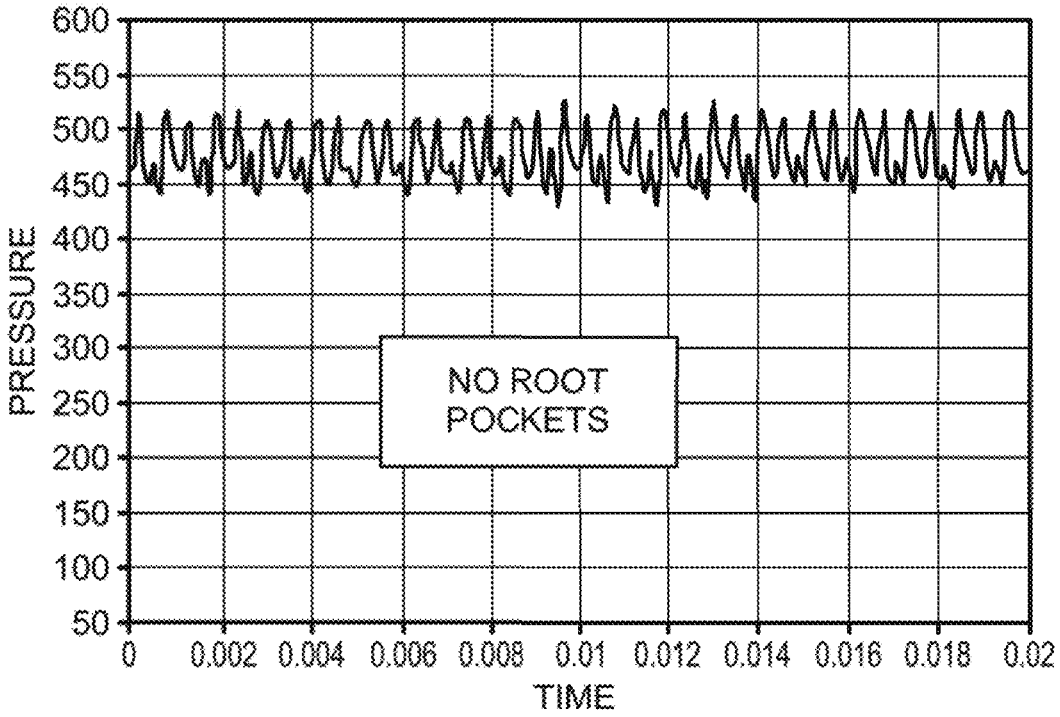
FIG. 19A is a graph of measured pressure versus time for a MFP-590 pump with only the aggressive bearing design shown in FIG. 14, depicting the discharge pressure ripple.
Figure 19B:
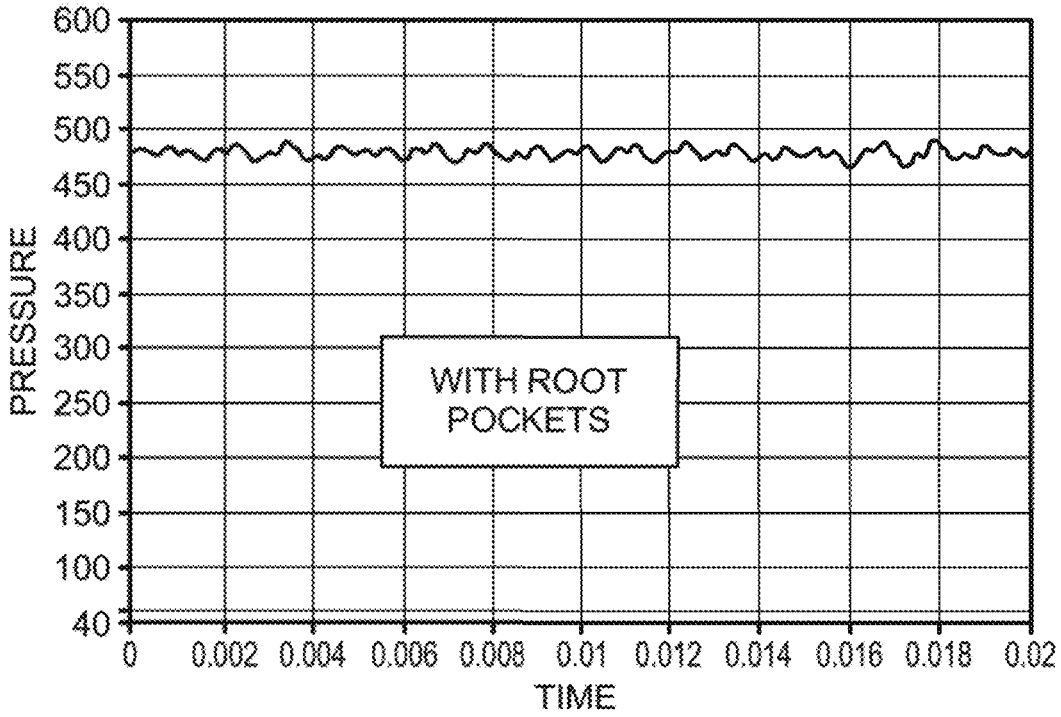
FIG. 19B is a graph of measured pressure versus time for a MFP-590 pump with the aggressive bearing design shown in FIG. 14 and the pockets shown in FIG. 8, depicting the discharge pressure ripple.

Pressure tests were completed on the aggressive bearing design 580 and on the modification of adding the pockets 510. The gear speed and discharge pressure for the tests were 3,000 rpm and 462 psi, respectively, on a gear with a goal of a maximum of about 5% for the discharge pressure ripple. FIG. 19A is a graph of measured pressure versus time for a MFP-590 pump with only the aggressive bearing design 580, and shows a discharge pressure ripple of about ±30 psi or 6.5%. FIG. 19B is a graph of measured pressure versus time for a MFP-590 pump with the aggressive bearing design 580 and the pockets 510, and shows a discharge pressure ripple of about ±5 psi or 1%. The discharge pressure ripple was significantly quieted by adding the pockets 510. Thus, the addition of the pockets 510 converted the pump being tested from a pump that failed to meet performance targets to a pump that met the discharge pressure ripple goal.

Finally, a gear stress finite element analysis (FEA) was completed for the gear having the pockets 510 and the factor of safety (FOS) was calculated for that gear. When designing a product, an engineer seeks to achieve a required FoS. This requirement helps the engineer to provide an extra cushion of confidence that the component will not fail even if it is overloaded. The FoS can be calculated in different ways. Ultimately, however, each calculation checks the amount of safety load beyond the designed workload so the FoS=Actual Load/Working Load. If a component is not safe, a significant risk of component failure arises. If the FoS is 1, then the design load is equal to the safety load. For a safer design, therefore, the FoS should be always greater than 1. If the FoS is less than 1, then the risk of failure is too high. A typical FOS for aircraft components is between 1.5 and 2.

An analysis was done on the Model MFP-590 fuel pump having a gear with the pockets 510. The maximum operating condition for the gear was selected for testing because that condition represents the highest torque on the gear. For the application analyzed, that condition is defined at an applied torque to the gear teeth of about 500 in-lbf; a speed of about 6,618 rpm; and a pressure of about 1,600 psid. One of the most commonly used fuels for commercial aviation, Jet A, constituted the fluid. Consistent with a conservative approach, the analysis assumed a single tooth tip contact—although, in reality, the load would be distributed among several gear teeth.

The gear was made of CPM-10V steel, which is strong and resistant to wear. The gear teeth were subject to a nitriding surface treatment to provide further wear resistance. Nitriding is a thermochemical treatment process applied to enrich the surface with nitrogen for the purpose of increasing the surface hardness. The process is based on the low solubility of nitrogen in the ferritic crystal structure to promote the precipitation of iron nitrides or alloy nitrides. In the transverse direction, the yield strength of the gear material was about 70.4 ksi; yield stress is the stress limit after which the material starts deforming. The endurance limit (R=−1) of the gear material was about 54.0 ksi; the endurance limit is defined as the stress range below which there is no crack growth and the material presents an infinite life under cyclic stresses.

The maximum principal stress or major principal stress is the maximum value of normal stress acting on one of the principal planes of a component (such as the gear under analysis) where the value of shear stress is zero. The maximum principal stress was calculated to be 17.5 ksi. Therefore, the FoS for high cycle fatigue for the gear was calculated as 54 ksi/17.5 ksi=3.1. High cycle fatigue is a type of fatigue caused by small elastic strains under a high number of load cycles before failure occurs. The stress comes from a combination of mean and alternating stresses. Thus, the FEA done for a gear with the pockets 510 showed not only an acceptable FOS, but a relatively high FoS.

Trapped fluids within pumping gear meshes expand and contract due to the gear motion during rotation. The sudden expansions and contractions lead to very large localized pressure swings. These high energy cycles can lead to cavitation damage in the surrounding hardware, such as bearing and gears. Pressure cycles can also cause an imbalance on the gears, resulting in high forces that create undesirable gear motion that leads to cavitation damage, and potential journal failure. The gear modified to include the pockets 510 reduces the pressure levels inherent in a gear mesh system, thus reducing cavitation and its damaging effects.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure. Uses and applications for the modified gear as disclosed include, for example, any application where trapped volume can experience changes in the volume.

What is claimed:

1. A gear having a gear tooth profile and comprising:

a body;

a plurality of involute gear teeth extending radially outward from the body, wherein each gear tooth of the plurality of involute gear teeth has a respective tip and a root, the gear tooth and a neighboring gear tooth defining a space between them; and a respective root pocket formed directly into the roots of the gear teeth and in the space between the respective gear tooth and the neighboring gear tooth, providing an increased gear root volume and adding trapped fluid compliance while leaving unaltered the gear tooth profile, and a beam being disposed in and spanning across a width of each root pocket, the beam extending into the depth of the root pocket.

2. The gear according to claim 1 wherein the root pocket has an oval shape.

3. The gear according to claim 2 wherein the root pocket has a depth of about 0.350 inches, a length of about 0.450 inches, a width of about 0.179 inches, and radii of curvature of about 0.060 inches.

4. The gear according to claim 1 wherein the gear has a first length, the root pocket has a second length, and the second length is less than the first length.

5. The gear according to claim 4 wherein the second length is between about 50% and about 80% of the first length.

6. The gear according to claim 5 wherein the second length is about 65% of the first length.

7. The gear according to claim 1 wherein the root pocket has a center and the beam spans across the center of the root pocket.

8. The gear according to claim 7 wherein the gear has a strength, the root pocket has a depth, and the beam divides the root pocket into two, separate sections while maximizing the strength of the gear.

9. The gear according to claim 1, wherein the beam splits the root pocket into a first pocket portion and a second pocket portion.

10. The gear according to claim 9, wherein the first pocket portion and the second pocket portion are in fluid communication.

11. A gear pump comprising:

a first gear having (i) a gear tooth profile, (ii) a first body, (iii) a first plurality of involute gear teeth extending radially outward from the first body and, each first gear tooth of the first plurality of involute gear teeth including a respective tip and a root, the first gear tooth and a neighboring first gear tooth defining a space between them, (iv) a respective root pocket formed directly into the roots of the first plurality of involute gear teeth and in the space between the first gear tooth and the neighboring first gear tooth, providing an increased gear root volume and adding trapped fluid compliance while leaving unaltered the gear tooth profile, and (v) a beam being disposed in and spanning across a width of each root pocket, the beam extending into the depth of the root pocket;

a second gear being configured to mesh with the first gear in a mesh zone that defines a gear mesh volume that is increased by the respective root pocket and having a second body and a second plurality of involute gear teeth extending radially outward from the second body;

a first gear bearing and a second gear bearing configured to position the first gear and the second gear along a bearing center line, wherein the root pocket does not extend into either the first or the second gear bearing; and a housing having a fluid inlet and a fluid outlet and in which are disposed the first gear, the second gear, first gear bearing, and the second gear bearing.

12. The gear pump according to claim 11 wherein the root pocket has an oval shape.

13. The gear pump according to claim 12 wherein the root pocket has a depth of about 0.350 inches, a length of about 0.450 inches, a width of about 0.179 inches, and radii of curvature of about 0.060 inches.

14. The gear pump according to claim 11 wherein the first gear has a first length, the root pocket has a second length, and the second length is less than the first length.

15. The gear pump according to claim 14 wherein the second length is between about 50% and about 80% of the first length.

16. The gear pump according to claim 15 wherein the second length is about 65% of the first length.

17. The gear pump according to claim 11 wherein the root pocket has a center and the beam in the first gear extends across the center of the root pocket.

18. The gear pump according to claim 11 wherein the first gear and the second gear define a gear mesh compression and the root pocket helps to reduce the gear mesh compression by a factor of about seven.

19. The gear pump according to claim 11 wherein the first gear and the second gear define a trapped volume and the root pocket helps to increase the trapped volume by about 600%.

20. The gear pump according to claim 11 wherein the gear pump has a discharge pressure ripple of about 1%.

21. The gear pump according to claim 11 wherein the gear pump has a high cycle fatigue factor of safety greater than three.

22. A gear having a gear tooth profile and comprising:

a body;

a plurality of involute gear teeth extending radially outward from the body;

wherein each gear tooth of the plurality of involute gear teeth has a respective tip and a root, the gear tooth and a neighboring gear tooth defining a space between them; and a respective root pocket formed directly into the roots of the gear teeth and in the space between the respective gear tooth and the neighboring gear tooth, providing an increased gear root volume and adding trapped fluid compliance while leaving unaltered the gear tooth profile, and a beam being disposed in and spanning across a width of each root pocket, the beam extending into the depth of the root pocket, wherein the beam splits the root pocket into a first pocket portion and a second pocket portion, and wherein the first pocket portion and the second pocket portion are in fluid communication.

* * * * *